US009470990B2

(12) United States Patent
Araki et al.

(10) Patent No.: US 9,470,990 B2
(45) Date of Patent: Oct. 18, 2016

(54) STORAGE FOR STORING DISPERSION LIQUID, AND TONER PRODUCING APPARATUS USING THE STORAGE

(71) Applicants: Taro Araki, Shizuoka (JP); Masashi Miyakawa, Shizuoka (JP); Toshihiko Usami, Shizuoka (JP)

(72) Inventors: Taro Araki, Shizuoka (JP); Masashi Miyakawa, Shizuoka (JP); Toshihiko Usami, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 73 days.

(21) Appl. No.: 14/628,675

(22) Filed: Feb. 23, 2015

(65) Prior Publication Data

US 2015/0259123 A1 Sep. 17, 2015

(30) Foreign Application Priority Data

Mar. 14, 2014 (JP) ..... 2014-051651

(51) Int. Cl.
*G03G 9/00* (2006.01)
*G03G 9/08* (2006.01)

(52) U.S. Cl.
CPC ..... *G03G 9/0804* (2013.01)

(58) Field of Classification Search
CPC ..... B65D 81/00; B65D 81/18; B65D 81/22; G03G 9/00; G03G 9/08–9/0804
See application file for complete search history.

(56) References Cited

U.S. PATENT DOCUMENTS

| | | | | |
|---|---|---|---|---|
| 7,585,607 | B2 * | 9/2009 | Miyakawa | G03G 9/0804 430/137.14 |
| 2006/0216629 | A1 | 9/2006 | Miyakawa et al. | |
| 2008/0182186 | A1 | 7/2008 | Usami et al. | |
| 2008/0311504 | A1 | 12/2008 | Hattori et al. | |
| 2011/0236818 | A1 * | 9/2011 | Yamada | G03G 9/0819 430/109.4 |

FOREIGN PATENT DOCUMENTS

| | | |
|---|---|---|
| JP | 2002-258529 | 9/2002 |
| JP | 2004-252387 | 9/2004 |
| JP | 2006-078972 | 3/2006 |
| JP | 2006-084979 | 3/2006 |
| JP | 2010121059 A * | 6/2010 |
| JP | 2010-217632 | 9/2010 |
| JP | 2011-095322 | 5/2011 |
| JP | 2011-253135 | 12/2011 |

OTHER PUBLICATIONS

Machine translation JP 2010-121059 A, published on Jun. 3, 2010.*

* cited by examiner

*Primary Examiner* — Natasha Young
(74) *Attorney, Agent, or Firm* — Oblon, McClelland, Maier & Neustadt, L.L.P.

(57) ABSTRACT

A storage to store a dispersion liquid in which particles including a resin are dispersed in a solvent is provided. The storage includes a storage tank to store the dispersion liquid, which is arranged on a passage leading from a dispersion liquid producing device to produce the dispersion liquid to a solvent removing device to remove the solvent from the dispersion liquid; and a pressure adjuster to adjust the pressure of the dispersion liquid in the storage tank to a pressure between the pressure of the dispersion liquid in the dispersion liquid producing device and the pressure of the dispersion liquid in the solvent removing device.

11 Claims, 2 Drawing Sheets

STORAGE FOR STORING DISPERSION LIQUID, AND TONER PRODUCING APPARATUS USING THE STORAGE

CROSS-REFERENCE TO RELATED APPLICATIONS

This patent application is based on and claims priority pursuant to 35 U.S.C. §119 to Japanese Patent Application No. 2014-051651 filed on Mar. 14, 2014 in the Japan Patent Office, the entire disclosure of which is hereby incorporated by reference herein.

BACKGROUND

1. Technical Field

This disclosure relates to a storage to store a dispersion liquid in which particles including a resin are dispersed in a solvent, and to a toner producing apparatus using the storage.

2. Description of the Related Art

There is a toner producing apparatus, which includes a dispersion liquid producing device to produce a dispersion liquid, and a solvent removing device to remove a solvent from the dispersion liquid. The dispersion liquid producing device emulsifies an oil phase liquid, in which at least one of a binder resin of toner and a precursor of the binder resin, and a colorant are dispersed or dissolved in an organic solvent, in an aqueous solvent (aqueous medium) to form particles including the resin and the colorant in the emulsion, thereby producing a dispersion liquid in which droplets including the organic solvent and the particles (hereinafter sometimes referred to as resin particles) are dispersed in the aqueous solvent. The thus prepared dispersion liquid is fed to the solvent removing device. The solvent removing device removes the organic solvent from the dispersion liquid to prepare a concentrated liquid of the dispersion liquid. The concentrated liquid is centrifuged using a centrifuge to separate the solid component (i.e., resin particles) from the liquid and the solid component is dried. The solid component is optionally subjected to a classification treatment using a classifier to prepare toner particles of a toner.

The toner production method including the process of producing a dispersion liquid is classified into a batch toner production method in which a series of processes of from a raw material feeding process to a resin particle granulating process are performed as a batch process, and a continuous toner production method in which raw materials are continuously fed little by little and a dispersion liquid including granulated resin particles is continuously produced little by little.

Recently, with the growth of demand for high quality images, a need exists for a toner having a smaller particle diameter and a narrower particle diameter distribution. Therefore, a need exists for a toner producing apparatus capable of producing toner particles having a smaller particle diameter and a narrower particle diameter distribution.

SUMMARY

As an aspect of this disclosure, a storage to store a dispersion liquid, in which particles including a resin are dispersed in a solvent, is provided which includes a storage tank to store the dispersion liquid, which is arranged on a passage leading from a dispersion liquid producing device to produce the dispersion liquid to a solvent removing device to remove the solvent from the dispersion liquid; and a pressure adjuster to adjust the pressure of the dispersion liquid in the storage tank to fall in a range of from the pressure of the dispersion liquid in the dispersion liquid producing device to the pressure of the dispersion liquid in the solvent removing device.

As another aspect of this disclosure, a toner producing apparatus is provided which includes a dispersion liquid producing device to produce a dispersion liquid in which particles including a resin are dispersed in a solvent; a solvent removing device to remove the solvent from the dispersion liquid; and the storage arranged in a passage leading from the dispersion liquid producing device to the solvent removing device to store the dispersion liquid.

The aforementioned and other aspects, features and advantages will become apparent upon consideration of the following description of the preferred embodiments taken in conjunction with the accompanying drawings.

DETAILED DESCRIPTION

Figure 1:
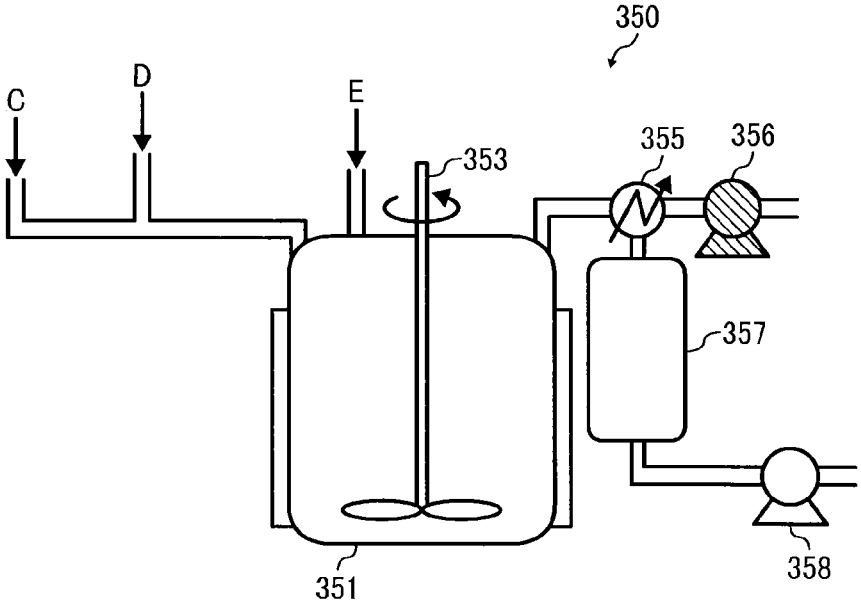
FIG. 1 RELATED ART
FIG. 1 is a schematic view illustrating a solvent removing device of a conventional batch toner producing apparatus.

As a result of the present inventors' investigation, it is found that in each of the batch toner production method and the continuous toner production method, a large pressure difference is formed on the dispersion liquid, which is present on the way from the dispersion liquid producing device to the solvent removing device, thereby preventing narrowing of the particle diameter distribution of resin particles (toner particles).

The pressure difference will be described in detail. Specifically, it is typical in a solvent removing device to reduce the pressure applied to the dispersion liquid and the organic solvent evaporated from the dispersion liquid so as to be lower than the atmospheric pressure in order to efficiently evaporate the organic solvent from the dispersion liquid. However, in dispersion liquid producing devices using the continuous toner production method, a pressure higher than the atmospheric pressure is typically applied to the mixture liquid of raw materials in order to efficiently produce resin particles in the emulsion. In addition, in storage tanks used for the batch toner production method, the dispersion liquid is typically stored at a normal pressure. Therefore, a large pressure difference is formed between the dispersion liquid in the solvent removing device, and the dispersion liquid in the dispersion liquid producing device used for the continuous toner production method or the dispersion liquid in the storage tank used for the batch toner production method.

In order to form the large pressure difference, a squeeze pump and a decompression valve such as back pressure valves are typically provided in a liquid feeding passage (hereinafter referred to as a passage) connecting the solvent removing device with the dispersion liquid producing device used for the continuous toner production method or the storage tank used for the batch toner production method. In this regard, the squeeze pump feeds the dispersion liquid in the dispersion liquid producing device used for the continuous toner production method or the storage tank used for the batch toner production method to the solvent removing device, and the decompression valve is opened when the pressure to the dispersion liquid present on the upstream side from the squeeze pump relative to the dispersion liquid flowing direction exceeds a predetermined threshold value to prevent excessive increase of the pressure to the dispersion liquid, wherein a back pressure valve, which has a function to automatically open when the pressure to the dispersion liquid exceeds the predetermined threshold value, is typically used as the decompression valve. Alternatively, a method using a control program such that an electromagnetic valve is opened or closed depending on the pressure to the dispersion liquid can also be used. On the downstream side from the decompression valve, the pressure to the dispersion liquid is decreased due to decrease in pressure inside the solvent removing device. When the decompression valve is opened, the dispersion liquid, which is present on the upstream side from the decompression valve and which has a high pressure, is vigorously sucked due the negative pressure on the downstream side from the decompression valve, resulting in movement of the dispersion liquid at a very high speed through the passage after the decompression valve. In this case, a large stress is applied to the resin particles in the dispersion liquid, thereby causing problems such that the resin particles are further pulverized, resulting in formation of fine particles; and the resin particles are united, resulting in formation of large resin particles, and therefore the particle diameter distribution of the toner particles is broadened.

In view of the above-mentioned problems in the related art, it is an object of this disclosure to provide a storage for storing a dispersion liquid including resin particles, and a toner producing apparatus, which can prevent broadening of the particle diameter distribution of the resin particles caused by the pressure difference before and after a decompression valve provided to feed the dispersion liquid prepared by the dispersion liquid producing device to the next process.

Initially, the toner production method used for the toner producing apparatus of this disclosure will be described in detail.

The toner production method produces toner particles by performing a dispersion liquid production process, and a solvent removal process. In the dispersion liquid production process, a toner composition including at least one of a binder resin and a binder resin precursor, and a colorant is dissolved or dispersed in an organic solvent to prepare an oil phase liquid. In addition, an aqueous solvent (i.e., an aqueous medium or an aqueous phase liquid) is provided. The oil phase liquid and the aqueous solvent are mixed to prepare an emulsion in which resin particles are granulated and dispersed. Thus, a dispersion in which droplets including the organic solvent and the resin particles are dispersed in the aqueous solvent is produced in the dispersion liquid production process. In the solvent removal process, the organic solvent is removed from the dispersion liquid to prepare resin particles (i.e., toner particles). In reality, a process in which the thus prepared resin particles are repeatedly subjected to washing and drying to produce dry toner particles, a process in which the dry toner particles are mixed with an external additive, and a process in which aggregates and coarse particles are removed from the dry toner particles, are also performed.

Suitable materials for use as the binder resin to be added to an organic solvent include resins which can be dissolved in the organic solvent at least partially and which have an acid value of from 2 to 26 mgKOH/g. When the acid value is greater than 26 mgKOH/g, the resin tends to easily migrate into the aqueous solvent (aqueous phase liquid), thereby increasing loss of the binder resin in the toner production process while deteriorating dispersion stability of the resin particles in the oil phase liquid. In contrast, when the acid value is less than 2 mgKOH/g, it becomes difficult to evenly disperse the colorant in the oil phase liquid because the polarity of the binder resin seriously decreases, thereby making it impossible to evenly disperse the colorant in the oil phase liquid.

Specific examples of the binder resin include, but are not limited thereto, polyester, homopolymers of styrene or styrene derivatives (such as polystyrene, poly-p-chlorostyrene and polyvinyl toluene); styrene copolymers (such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl a-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers), homopolymers of methacrylates (such as polymethyl methacrylate and polybutyl methacrylate), homopolymers of vinyl compounds (such as polyvinyl chloride, polyvinyl acetate, polyethylene and polypropylene), aliphatic hydrocarbon resins, alicyclic hydrocarbon resins, aromatic petroleum resins, and other resins (such as epoxy resins, epoxy-polyol resins, polyurethane, polyamide, polyvinyl butyral, polyacrylic acid, rosins, rosin, modified rosins, and terpene resins). These resins can be used alone or in combination.

When the toner prepared by the toner producing apparatus of this disclosure is used for developing an electrostatic latent image in electrophotography, a resin having a polyester skeleton is preferably used as a binder resin because good fixability can be imparted to the toner. Suitable materials for use as such a resin having a polyester skeleton include polyester resins, and block copolymers of a polyester resin and a resin having a skeleton other than the polyester skeleton. Among these resins, polyester resins are preferable because the resultant resin particles have good dispersion uniformity. In addition, a crystalline polyester resin is preferably used as part of the binder resin to impart good low temperature fixability to the resultant toner.

Specific examples of such polyester resins include ring-opening polymerization products of a lactone compound, condensation polymerization products of a hydroxycarboxylic acid, and polycondensation products of a polyalcohol and a polycarboxylic acid. From the viewpoint of flexibility in design of polymer, polycondensation products of a polyalcohol and a polycarboxylic acid are preferably used. The peak molecular weight of the polyester resin used for the toner is generally from 1,000 to 30,000, preferably from 1,500 to 10,000, and more preferably from 2,000 to 8,000. When the peak molecular weight is less than 1,000, a problem in that the high temperature preservability of the toner deteriorates tends to occur. In contrast, when the peak molecular weight is greater than 30,000, another problem in that the low temperature fixability of the toner deteriorates tends to occur when the toner is used as an electrophotographic toner for developing electrostatic latent images.

In the polycondensation method used for preparing a polyester resin, a polyalcohol and a polycarboxylic acid are heated to a temperature of from 150° C. to 280° C. in the presence of a catalyst such as tetrabutoxy titanate and dibutyltin oxide while optionally removing water generated by the reaction at a reduced pressure, to perform condensation polymerization.

Specific examples of the polyalcohol include, but are not limited thereto, dihydric alcohols such as ethylene glycol, diethylene glycol, triethylene glycol, propylene glycol, 1,4-bis(hydroxymethyl)cyclohexane, and bisphenol A; and polyalcohols having three or more hydroxyl groups. These can be used alone or in combination.

Specific examples of the polycarboxylic acid include, but are not limited thereto, dicarboxylic acids such as maleic acid, fumaric acid, phthalic acid, isophthalic acid, terephthalic acid, succinic acid, and malonic acid; and polycarboxylic acids having three or more carboxyl groups such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxy-2-methylenecarboxypropane, and 1,2,7,8-octanetetracarboxylic acid. These can be used alone or in combination.

Specific examples of the binder resin precursor (i.e., prepolymer) include, but are not limited thereto, monomers of styrene and derivatives of styrene such as styrene, α-methylstyrene, p-methylstyrene, and p-chlorostyrene; nitrile monomers such as acrylonitrile; (meth)acrylic monomers such as methyl (meth)acrylate, ethyl (meth)acrylate, butyl (meth)acrylate, ethylhexyl (meth)acrylate, lauryl (meth)acrylate, and stearyl (meth)acrylate; and conjugated diene monomers such as butadiene and isoprene. These can be used alone or in combination. Among various prepolymers, prepolymers having a functional group capable of reacting with an active hydrogen atom are preferable. Such a prepolymer having a functional group capable of reacting with an active hydrogen atom is reacted with a compound having an active hydrogen atom to prepare a binder resin of the toner.

The functional group having an active hydrogen atom is not particularly limited, and specific examples thereof include hydroxyl groups (such as alcoholic hydroxyl group and phenolic hydroxyl group), amino groups, carboxyl groups, and mercapto groups. Compounds having one or more of these groups can be used. Among these groups, amino groups are preferable because by reacting a compound having an amino group with a polyester prepolymer having an isocyanate group, a urea-modified polyester resin can be prepared, and the urea-modified polyester resin can be preferably used as a binder resin of the toner.

The functional group of the prepolymer to be reacted with an active hydrogen atom is not particularly limited. Specific examples of the prepolymer include polyester prepolymers, polyol prepolymers, acrylic prepolymers, and epoxy prepolymers, which have one or more of an isocyanate group, an epoxy group, a carboxyl group, and a chlorocarbonyl group. Among these prepolymers, polyester prepolymers having an isocyanate group are preferable because by reacting the polyester prepolymers with a compound having an amino group, a urea-modified polyester resin can be produced, and the urea-modified polyester resin can be preferably used as a binder resin of the toner.

Polyester prepolymers having an isocyanate group can be prepared by reacting a polyester resin having a hydroxyl group with a polyisocyanate at a temperature of from 40 to 140° C. optionally adding an organic solvent thereto.

The organic solvent optionally used is not particularly limited as long as the solvent is inactive with the polyisocyanate used. Specific examples of such an organic solvent include aromatic hydrocarbons such as toluene and xylene; ketones such as acetone, methyl ethyl ketone and methyl isobutyl ketone; esters such as ethyl acetate and butyl acetate; amides such as dimethylformamide and dimethylacetoamide; and ethers such as tetrahydrofuran. These can be used alone or in combination.

The polyester resin having a hydroxyl group for use in preparing polyester prepolymers can be prepared by subjecting a polyalcohol with a polycarboxylic acid to a polycondensation reaction as mentioned above.

The polyalcohol is not particularly limited, and dihydric alcohols, tri- or more-hydric alcohols, and mixtures thereof can be used. Among these, dihydric alcohols and mixtures of a dihydric alcohol and a tri- or more-hydric alcohol are preferably used.

Specific examples of such dihydric alcohols include alkylene glycols such as ethylene glycol, 1,2-propylene glycol, 1,3-propylene glycol, 1,4-butanediol, and 1,6-hexanediol; polyalkylene glycols such as diethylene glycol, triethylene glycol, dipropylene glycol, polyethylene glycol, polypropylene glycol and polybutylene glycol; alicyclic dialcohols such as 1,4-cyclohexane dimethanol and hydrogenated bisphenol A; alkylene oxide (such as ethylene oxide, propylene oxide and butylene oxide) adducts of alicyclic dialcohols; bisphenols such as bisphenol A, bisphenol F and bisphenol S; alkylene oxide (such as ethylene oxide, propylene oxide and butylene oxide) adducts of bisphenols; etc.

Among these, alkylene glycols having 2 to 12 carbon atoms and alkylene oxide adducts of bisphenols are preferable, and alkylene oxide adducts of bisphenols, mixtures of an alkylene oxide adduct of a bisphenol compound and an alkylene glycol having 2 to 12 carbon atoms are more preferable.

Specific examples of the tri- or more-hydric alcohols include tri- or more-hydric aliphatic alcohols such as glycerin, trimethylol ethane, trimethylol propane, pentaerythritol and sorbitol; tri- or more-hydric polyphenols such as trisphenols (such as TRISPHENOL PA from HONSHU CHEMICAL INDUSTRY CO., LTD.), phenol novolac and cresol novolac; alkylene oxide (such as ethylene oxide, propylene oxide and butylene oxide) adducts of tri- or more-hydric polyphenols; etc.

The polycarboxylic acid is not particularly limited, and dicalboxylic acids, tri- or more-carboxylic acids having three or more carboxyl groups, and mixtures thereof can be used. Among these, dicarboxylic acids and mixtures of a dicarboxylic acid and a tri- or more-carboxylic acid are preferably used.

Specific examples of the dicarboxylic acids include alkylene dicalboxylic acids such as succinic acid, adipic acid and sebacic acid; alkenylene dicarboxylic acids such as maleic acid and fumaric acid; aromatic dicarboxylic acids such as phthalic acid, isophthalic acid and terephthalic acid; etc. Among these, alkenylene dicarboxylic acids having 4 to 20 carbon atoms, and aromatic dicarboxylic acids having 8 to 20 carbon atoms are preferable.

Specific examples of the tri- or more-carboxylic acids having three or more carboxyl groups include aromatic polycarboxylic acids such as trimellitic acid and pyromellitic acid; etc. Among these, aromatic polycarboxylic acids having 9 to 20 carbon atoms are preferable.

Anhydrides or lower alkyl esters (such as methyl, ethyl and isopropyl esters) of the above-mentioned polycarboxylic acids can also be used.

When preparing a polyester having a hydroxyl group, the equivalence ratio ([OH]/[COOH]) of the hydroxyl group of a polyalcohol to the carboxyl group of a polycarboxylic acid is preferably from 1 to 2, more preferably from 1 to 1.5, and even more preferably from 1.02 to 1.3.

The polyisocyanate for use in preparing the above-mentioned polyester prepolymers is not particularly limited. Specific examples thereof include aliphatic polyisocyanates such as tetramethylene diisocyanate, hexamethylene diisocyanate, 2,6-diisocyanato methylcaproate, octamethylene diisocyanate, decamethylene diisocyanate, dodecamethylene diisocyanate, tetradecamethylene diisocyanate, trimethylhexane diisocyanate and tetramethylhexane diisocyanate; alicyclic polyisocyanates such as isophorone diisocyanate and cyclohexylmethane diisocyanate; aromatic didicosycantes such as tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate and diphenylether-4,4'-diisocyanate; aromatic aliphatic diisocyanates such as α,α,α',α'-tetramethyl xylylene diisocyanate; isocyanurates such as tris(isocyanatoalkyl)isocyanurate and triiscyanatocycloalkylisocyanurate; etc. These can be used alone or in combination.

Blocked polyisocyanates such as polyisocyanates blocked with a compound such as phenol derivatives, oximes, and caprolactams can also be used as the polyisocyanate.

Suitable mixing ratio of a polyisocyanate to a polyester having a hydroxyl group (i.e., an equivalence ratio [NCO]/[OH] of the isocyanate group of the polyisocyanate to the hydroxyl group of the polyester) is from 1 to 5, preferably from 1.2 to 4, and more preferably from 1.5 to 2.5.

The content of the unit derived from a polyisocyanate in the polyester prepolymer is preferably from 0.5 to 40% by weight, more preferably from 1 to 30% by weight, and even more preferably from 2 to 20% by weight, based on the weight of the polyester prepolymer.

The compound having an amino group to be reacted with the polyester prepolymer is not particularly limited, and dimanies, tri- or more-amines, amino alcohols, amino mercaptans, amino acids, etc. can be used. These can be used alone or in combination. Among these, diamines, and mixtures of a diamine and a tri- or more-amine are preferable.

Specific examples of the diamines include aromatic diamines such as phenylenediamine, diethyltoluenediamine and 4,4'-diaminodiphenylmethane; alicyclic diamines such as 4,4'-diamino-3,3'-dimethyldicyclohexylmethane, diaminocyclohexane and isophoronediamine; aliphatic diamines such as ethylenediamine, tetramethylenediamine and hexamethylenediamine; etc. Specific examples of the tri- or more-amines include diethylenetriamine, triethylenetetramine, etc.

Specific examples of the aminoalcohols include ethanolamine, hydroxyethylaniline, etc.

Specific examples of the amino mercaptans include aminoethyl mercaptan, aminopropyl mercaptan, etc.

Specific examples of the amino acids include aminopropionic acid, aminocaproic acid, etc.

Blocked amines such as ketimines and oxazolines, in which the amino group of compounds having an amino group is blocked, can also be used as the compound having an amino group.

The mixing ratio of a polyester prepolymer having an isocyanate group to an amine (i.e., an equivalence ratio [NCO]/[NHx] of the isocyanate group of the polyester prepolymer to the amino group of the amine) is from 0.5 to 2, preferably from ⅔ to 1.5, and more preferably from ⅚ to 1.2.

When a polyester prepolymer is reacted with a compound having an amino group, a catalyst such as dibutyltin laurate and tioctyltin laurate can be used.

The reaction temperature at which a polyester prepolymer having an isocyanate group is reacted with a compound having an amino group is generally from 0 to 150° C., and preferably from 40 to 98° C., and the reaction time is generally from 10 minutes to 40 hours, and preferably from 2 hours to 24 hours.

In order to terminate the reaction of a polyester prepolymer with a compound having an amino group, a reaction terminator is preferably used. By using such a reaction terminator, the molecular weight of the resultant urea-modified polyester resin can be controlled.

Specific examples of such a reaction terminator include monoamines such as diethylamine, dibutylamine, butylamine and laurylamine, and blocked amines (such as ketimines and oxazolines) of these monoamines.

The toner can include such a urea-modified polyester as a binder resin. The urea-modified polyester can be prepared by reacting a polyester prepolymer having an isocyanate group with a compound having an amino group at a temperature of from 0 to 140° C. while optionally adding an organic solvent thereto.

The organic solvent optionally added is not particularly limited as long as the solvent is inactive with the isocyanate group. Specific examples of the organic solvent include aromatic solvents such as toluene and xylene; ketones such as acetone, methyl ethyl ketone and methyl isobutyl ketone; esters such as ethyl acetate and butyl acetate; amides such as dimethylformaide and dimethylacetamide; ethers such as tetrahydrofuran; etc. These can be used alone or in combination.

The colorant used for the toner is not particularly limited, and any known dyes and pigments can be used. Specific examples of such dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian Blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials are used alone or in combination.

The content of such a colorant in the toner is preferably from 1% to 15% by weight, and more preferably from 3% to 10% by weight of the toner. When the content is less than 1% by weight, the tinting power of the toner tends to deteriorate. In contrast, when the content is greater than 15% by weight, the colorant tends to be defectively dispersed in the toner particles, thereby deteriorating the tinting power and the electric properties of the toner.

Master batches, which are complexes of a colorant with a resin, can also be used as the colorant of the toner.

Specific examples of the resin include, but are not limited thereto, polyester, homopolymers of styrene or styrene derivatives (such as polystyrene, poly-p-chlorostyrene and polyvinyl toluene); styrene copolymers (such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers), homopolymers of methacrylates (such as polymethyl methacrylate and polybutyl methacrylate), homopolymers of vinyl compounds (such as polyvinyl chloride resins, polyvinyl acetate resins, polyethylene resins and polypropylene resins), aliphatic hydrocarbon resins, alicyclic hydrocarbon resins, aromatic petroleum resins, other resins (such as epoxy resins, epoxypolyol resins, polyurethane, polyamide, polyvinyl butyral, polyacrylic acid, rosins, modified rosins, and terpene resins), and waxes such as chlorinated paraffin and paraffin waxes. These resins can be used alone or in combination.

Such master batches can be prepared by mixing and kneading a colorant and a resin while applying a high shearing force thereto. In this regard, in order to enhance the interaction between the colorant and the resin, it is preferable to add an organic solvent. In addition, a flushing method, in which an aqueous paste of a colorant (pigment) is mixed and kneaded by a high shear disperser (such as three-roll mills) with a resin and an organic solvent to transfer the pigment to the resin (i.e., the organic solvent solution of the resin), followed by removing water and the organic solvent therefrom, is preferably used because a wet cake of the pigment can be used without drying the wet cake.

The toner optionally includes a release agent. The release agent is not particularly limited, and polyolefin waxes such as polyethylene waxes and polypropylene waxes; long-chain hydrocarbons such as paraffin waxes and SASOLWAX; waxes having a carbonyl group; etc. can be used. These can be used alone or in combination. Among these, waxes having a carbonyl group are preferable.

Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); dialkyl ketones (e.g., distearyl ketone); etc. Among these waxes having a carbonyl group, esters of polyalkanoic acids are preferable.

The melting point of such a release agent to be optionally included in the toner is generally from 40° C. to 160° C., preferably from 50° C. to 120° C., and more preferably from 60° C. to 90° C. When the melting point is lower than 40° C., the high temperature preservability of the toner tends to deteriorate. In contrast, when the melting point is higher than 160° C., a cold offset problem in that part or entirety of a toner image is transferred to a fixing member, thereby forming an abnormal image tends to be caused when the toner image is fixed at a relatively low temperature.

The melt viscosity of the release agent at a temperature 20° C. higher than the melting point of the release agent is preferably from 0.005 to 1 Pa·s, and more preferably from 0.01 to 0.1 Pa·s. When the melt viscosity is greater than 1 Pa·s, the effect of the release agent to enhance the hot offset resistance and the low temperature fixability tends to be insufficiently produced.

The content of such a release agent in the toner is generally from 0 to 40% by weight, and preferably from 3 to 30% by weight, based on the weight of the toner.

Next, the organic solvent for use in preparing the oil phase liquid will be described. In this regard, the organic solvent is an organic solvent, which is used for preparing the oil phase liquid and in which the toner composition including a colorant and at least one of a binder resin and a binder resin precursor can be dissolved or dispersed. The organic solvent is not particularly limited as long as the binder resin and the binder resin precursor can be dissolved therein, and specific examples thereof include aromatic solvents such as toluene and xylene; ketones such as acetone, methyl ethyl ketone and methyl isobutyl ketone; esters such as ethyl acetate and butyl acetate; amides such as dimethylformamide and dimethylacetamide; ethers such as tetrahydrofuran; etc. These can be used alone or in combination. Among these, volatile organic solvents having a boiling point of lower than 150° C. are preferable because such solvents can be easily removed in the solvent removal process. In this regard, if the toner composition includes a binder resin precursor, it is necessary for the organic solvent to be inactive with the binder resin precursor.

The toner composition can include a modified layered inorganic material. In this regard, layered inorganic materials are defined as inorganic minerals in which layers having a thickness of few nanometers are overlapped, and "modified" means that the layered inorganic materials are modified such that one or more organic ions are incorporated as interlayer ions. This is called intercalation in a broad sense.

Specific examples of the layered inorganic materials include smectite family (e.g., montmorillonite and saponite), kaolin family (e.g., kaolinite), magadiite, and kanemite. Because of having a layered structure, the layered inorganic materials have good hydrophilicity. Therefore, when such an unmodified layered inorganic material is included in a toner composition liquid (i.e., oil phase liquid) and the toner composition liquid is dispersed in an aqueous medium to prepare toner particles, the unmodified layered inorganic material migrates into the aqueous medium, and thereby deformed toner particles cannot be formed (i.e., spherical toner particles are formed and toner particles having forms other than spherical form cannot be prepared). When modified layered inorganic materials, which have a greater hydrophobicity (less hydrophilicity) than unmodified layered inorganic materials, are used, the materials form relatively fine toner particles with forms other than the spherical form in a granulation process (i.e., a toner particle preparation process). In addition, the materials tend to be present in a surface portion of the resultant toner particles, and thereby a good charge controlling function of the modified layered inorganic material can be imparted to the toner. Further, the modified layered inorganic materials present in a surface portion of the resultant toner particles can impart a good low temperature fixability to the toner particles.

The modified layered inorganic material for use in the toner is preferably layered inorganic materials having a smectite crystal form and modified by an organic cation. In addition, it is preferable to replace part of divalent metal ions of the layered inorganic materials with a trivalent metal ion to incorporate a metal anion in the layered inorganic materials. In this regard, the metal-anion-incorporated layered inorganic materials have high hydrophilicity, and therefore it is preferable to replace at least part of the metal anions with an organic anion.

Suitable organic compounds for use in incorporating organic ions in layered inorganic materials include quaternary alkyl ammonium salts, phosphonium salts, imidazolium salts, etc. Among these compounds, quaternary alkyl ammonium salts are preferable. Specific examples of such quaternary alkyl ammonium salts include trimethylstearyl ammonium, dimethylstearylbenzyl ammonium, dimethyloctadecyl ammonium, oleylbis(2-hydroxyethyl)methyl ammonium, etc.

Specific examples of other organic compounds for use in incorporating organic ions in layered inorganic materials include sulfates, sulphonates, carboxylates, and phosphates having a group (or a structure) such as linear, branched or cyclic alkyl groups (C1-C44), alkenyl groups (C1-C22), alkoxy groups (C8-C32), hydroxyalkyl groups (C2-C22), ethylene oxide structure, and propylene oxide structure. Among these compounds, carboxylic acids having an ethylene oxide structure are preferably used.

When at least part of interlayer ions of layered inorganic materials is modified with an organic ion, the modified layered inorganic materials have proper hydrophobicity. By including such modified layered inorganic materials in an oil phase liquid, the oil phase liquid has a non-Newtonian viscosity, and thereby deformed toner particles can be prepared. In this regard, the added amount of such a modified layered inorganic material in the toner composition liquid is preferably from 0.1 to 5% by weight, based on the total weight of the solid components included in the toner composition liquid. When the added amount is less than 0.1% by weight, the effect to enhance the charging property of the toner tends to deteriorate. In contrast, when the added amount is greater than 5% by weight, the fixing property of the toner tends to deteriorate.

The modified layered inorganic material for use in the toner is not particularly limited, and modified versions of montmorillonite, bentonite, hectorite, attapulgite, sepiolite, and mixtures of these materials are preferably used as the modified layered inorganic material. Among these materials, montmorillonite and bentonite, which are modified by an ion of an organic material, are preferably used because the modified layered inorganic materials can easily adjust the viscosity of the oil phase liquid even in a small added amount without deteriorating other properties of the resultant toner.

Specific examples of the marketed products of such organic-cation-modified layered inorganic materials include quaternium 18 bentonite such as BENTONE 3, BENTONE 38, BENTONE 38V, (from Elementis Specialties), THIXOGEL VP (from United Catalyst), CLAYTON 34, CLAYTON 40, and CLAYTON XL (from Southern Clay Products); stearalkonium bentonite such as BENTONE 27 (from Elementis Specialties), THIXOGEL LG (from United Catalyst), CLAYTON AF and CLAYTON APA (from Southern Clay Products); quaternium 18/benzalkonium bentonite such as CLAYTON HT and CLAYTON PS (from Southern Clay Products); etc. Among these materials, CLAYTON AF and CLAYTON APA are preferably used.

Specific examples of the marketed products of organic-anion-modified layered inorganic materials include materials which are prepared by modifying DHT-4A (from Kyowa Chemical Industry Co., Ltd.) with a material having the following formula (such as HITENOL 330T from Dai-ichi Kogyo Seiyaku Co., Ltd.):

$$R_1(OR_2)_nOSO_3M,$$

wherein $R_1$ represents an alkyl group having 13 carbon atoms, $R_2$ represents an alkylene group having 2 to 6 carbon atoms, n is an integer of from 2 to 10, and M represents a monovalent metal element.

Next, the charge controlling agent for use in the toner will be described. The charge controlling agent is not particularly limited, and specific examples thereof include Nigrosine dyes, triphenyl methane dyes, chromium-containing metal complex dyes, molybdic acid chelate pigments, Rhodamine dyes, alkoxyamines, quaternary ammonium salts, alkylamides, phosphor and its compounds, tungsten and its compounds, fluorine-containing surfactants, metal salts of salicylic acid, metal salts of salicylic acid derivatives, copper phthalocyanine, perylene, quinacridone, azo pigments, polymers having a functional group such as sulfonate group, carboxyl group, and quaternary ammonium group, etc.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.

In order to securely fix the charge controlling agent to the surface of toner particles, fluorine-containing ammonium salts are preferably used among the charge controlling agents. Fluorine-containing ammonium salts have good affinity for the carboxyl group while being easily dissolved in water including an alcohol. In this regard, a combination of a fluorine-containing ammonium salt and a metal-containing azo dye can be used as the charge controlling agent.

The fluorine-containing quaternary ammonium salt for use in the toner is not particularly limited, but compounds having the following formula are preferably used.

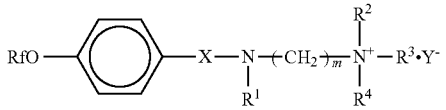

In the formula, Rf represents a perfluoroalkyl group, X represents a divalent organic group, each of $R^1$, $R^2$, $R^3$, and $R^4$ independently represents a hydrogen atom, a fluoro group or a hydrocarbon group, $Y^-$ represents a counter ion, and m is an integer of not less than 1.

The carbon number of the group Rf is generally from 3 to 60, preferably from 3 to 30, and more preferably from 3 to 15. The group Rf is not particularly limited, and specific examples thereof include $CF_3(CF_2)_5$—, $CF_3(CF_2)_6$—, $CF_3(CF_2)_7$—, $CF_3(CF_2)_8$—, $CF_3(CF_2)_9$—, $CF_3(CF_2)_{10}$—, $CF_3(CF_2)_{11}$—, $CF_3(CF_2)_{12}$—, $CF_3(CF_2)_{13}$—, $CF_3(CF_2)_{14}$—, $CF_3(CF_2)_{15}$—, $CF_3(CF_2)_{16}$—, $CF_3(CF_2)_{17}$—, $(CF_3)_2CF(CF_2)_6$—, etc.

The counter ion $Y^-$ is not particularly limited, and specific examples thereof include halogenide ions, sulfate ions, nitrate ions, phosphate ions, thiocyanate ions, organic acid ions, etc. Among these ions, halogenide ions such as fluoride ion, chloride ion, bromide ion, and iodide ion are preferable.

The group X is not particularly limited, and specific examples thereof include —$SO_2$—, —CO—, —$(CH_2)_x$—, —$SO_2N(R5)$—$(CH_2)_x$—, —$(CH_2)_x$—CH(OH)—$(CH_2)_x$—, etc., wherein x is an integer of from 1 to 6, and R5 represents an alkyl group having 1 to 10 carbon atoms. Among these, —$SO_2$—, —CO—, —$(CH_2)_x$—, —$SO_2N(C_2H_5)$—$(CH_2)_2$— and —$CH_2CH(OH)CH_2$— are preferable, and —$SO_2$— and —CO— are more preferable.

In the above-mentioned formula, m is preferably an integer of from 1 to 20, and more preferably an integer of from 1 to 10.

The hydrocarbon groups R1 to R4 are not particularly limited, and for example, alkyl groups, alkenyl groups and aryl groups, which may be substituted with a substituent, can be used therefor.

Among various alkyl groups, alkyl groups having 1 to 10 carbon atoms are preferable. Specific examples of such alkyl groups include methyl group, ethyl group, n-propyl group, iso-propyl group, n-butyl group, iso-butyl group, sec-butyl group, n-hexyl group, iso-hexyl group, n-heptyl group, n-octyl group, iso-octyl group, n-decyl group, and iso-decyl group.

Among various alkenyl groups, alkenyl groups having 2 to 10 carbon atoms are preferable. Specific examples of such alkenyl groups include vinyl group, ally! group, propenyl group, iso-propenyl group, butenyl group, hexenyl group, octenyl group, etc.

Among various aryl groups, aryl groups having 6 to 24 carbon atoms are preferable. Specific examples of the aryl groups include phenyl group, tolyl group, xylyl group, cumenyl group, styryl group, mesityl group, cinnamyl group, phenetyl group, benzhydryl group, etc.

The added amount of such a charge controlling agent is not particularly limited, and is preferably determined depending on choice of binder resin, presence or absence of additive, and the dispersing method used. However, the added amount is generally from 0.1 to 10 parts by weight, and preferably from 0.2 to 5 parts by weight, based on 100 parts by weight of the binder resin used. When the added amount is greater than 10 parts by weight, the charge of the toner is excessively increased, thereby causing problems such that the electrostatic attractive force between a developing roller and the toner seriously increases, resulting in deterioration of fluidity of the developer including the toner, and deterioration of image density of toner images.

In the dispersion liquid production process mentioned above, the oil phase liquid in which a colorant and at least one of a binder resin and a binder resin precursor are dissolved or dispersed is mixed with an aqueous solvent to prepare an emulsion while forming resin particles, thereby forming a resin dispersion liquid. In this regard, the volume average particle diameter of the resin particles is preferably from 3 to 8 μm, more preferably from 3 to 7 μm, and even more preferably from 4 to 7 μm.

The ratio (Dv/Dn) of the volume average particle diameter (Dv) of the granulated resin particles (toner) to the number average particle diameter (Dn) thereof is generally from 1.00 to 1.20, preferably from 1.00 to 1.17, and more preferably from 1.00 to 1.15. In this case, even when the toner is used for full color image forming apparatus, the toner can maintain good developing ability over a long period of time and can produce high quality images without causing a toner scattering problem in that the toner in the developing device is scattered and parts around the developing device are soiled with the toner, and a background development problem in that the background of toner images is soiled with the toner.

Suitable materials for use as the aqueous solvent (aqueous medium) include water and mixtures of water and a water-soluble solvent. Specific examples of such a water-soluble solvent include alcohols (such as methanol, isopropanol and ethylene glycol), dimethylformamide, tetrahydrofuran, cellosolves (such as methyl cellosolve), lower ketones (such as acetone and methyl ethyl ketone), etc.

In the dispersion liquid production process, a dispersant (surfactant) can be used. The dispersant is not particularly limited, and specific examples thereof include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, and polyhydric alcohol derivatives; and amphotic surfactants such as alanine, dodecylbis(aminoethyl) glycine, bis(octylaminoethyl)glycine, and N-alkyl-N,N-dimethylammonium betaine. In this regard, by using a surfactant having a fluoroalkyl group as the dispersant, the added amount of the dispersant can be reduced.

Specific examples of anionic surfactants having a fluoroalkyl group include fluoroalkyl carboxylic acids having from 2 to 10 carbon atoms and metal salts thereof, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and metal salts thereof, perfluoroalkyl(C7-C13) carboxylic acids and metal salts thereof, perfluoroalkyl(C4-C12)sulfonate and metal salts thereof, perfluorooctanesulfonic acid diethanolamide, N-propyl-N-(2-hydroxyethyl)perfluorooctanesulfonamide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16) ethylphosphates, etc. These can be used alone or in combination.

Specific examples of the marketed products of such anionic surfactants having a fluoroalkyl group include SARFRON S-111, S-112 and S-113, which are manufactured by Asahi Glass Co., Ltd.; FLUORAD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by DIC Corp.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

The cationic surfactants having a fluoroalkyl group for use as the dispersant is not particularly limited, and for example primary, secondary and tertiary aliphatic amines, aliphatic quaternary ammonium salts (such as perfluoroalkyl (C6-C10)sulfoneamidepropyltrimethylammonium salts), benzalkonium salts, benzetonium chloride, pyridinium salts, imidazolinium salts, etc., which have a fluoroalkyl group, can be used. These can be used alone or in combination.

Specific examples of the marketed products of such cationic surfactants having a fluoroalkyl group include SARFRON S-121 (from Asahi Glass Co., Ltd.); FLUORAD FC-135 (from Sumitomo 3M Ltd.); UNIDYNE DS-202 (from Daikin Industries, Ltd.); MEGAFACE F-150 and F-824 (from DIC Corp.); ECTOP EF-132 (from Tohchem Products Co., Ltd.); FUTARGENT F-300 (from Neos); etc.

In addition, a particulate resin and/or a particulate inorganic material can also be used as the dispersant. In this case, uniting of droplets of the oil phase liquid can be prevented, and therefore the oil phase liquid can be evenly dispersed in the aqueous medium.

The particulate resin for use as the dispersant is not particularly limited, and specific examples of the resin include vinyl resins, polyurethane, epoxy resins, polyester, polyamide, polyimide, silicone resins, phenolic resins, melamine resins, urea resins, aniline resins, ionomer resins, polycarbonate, etc. These can be used alone or in combination. Among these resins, vinyl resins, polyurethane, epoxy resins, and polyester are preferable because aqueous dispersions of fine spherical resin particles can be obtained.

Specific examples of the vinyl resins include styrene-(meth)acrylate copolymers, styrene-butadiene copolymers, (meth)acrylic acid-acrylate copolymers, styrene-acrylonitrile copolymers, styrene-maleic anhydride copolymers, styrene-(meth)acrylic acid copolymers, etc.

The particulate resin preferably includes a carboxyl group and more preferably a unit derived from (meth)acrylic acid, so that a charge controlling agent can be well fixed to the surface of the particulate resin.

The particulate inorganic material for use as the dispersant is not particularly limited, and specific examples of the inorganic material include silica, alumina, barium titanate, magnesium titanate, calcium titanate, strontium titanate, zinc oxide, tin oxide, silica sand, clay, mica, wollastonite, diatom earth, chromium oxide, cerium oxide, red iron oxide, antimony trioxide, magnesium oxide, zirconium oxide, barium sulfate, barium carbonate, calcium carbonate, silicon carbide, silicon nitride, tricalcium phosphate, hydroxyapatite, etc., but are not limited thereto. Among these, tricalcium phosphate, calcium carbonate, colloidal titanium oxide, colloidal silica, and hydroxyapatite are preferable, and hydroxyapatite, which is synthesized by reacting sodium phosphate with calcium chloride under a basic condition, is more preferable.

Further, it is preferable to stabilize droplets in the dispersion liquid using a polymer protection colloid in the dispersion liquid production process.

Specific examples of such protection colloids include polymers and copolymers prepared by using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), (meth) acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the protective colloid.

When a dispersant such as calcium phosphate, which can be dissolved in an acid or an alkali, is used, it is preferable to dissolve the dispersant using hydrochloric acid to remove the dispersant from the toner particles, followed by washing the resultant toner particles. In addition, it is possible to remove such a dispersant by decomposing the dispersant using an enzyme. Although toner particles, on the surface of which the dispersant used remains, can also be used for the toner, it is preferable that after the polymer chain growth reaction and/or the crosslinking reaction of the binder resin precursor, the toner particles are washed to remove the dispersant therefrom so that the resultant toner can have good charging property.

In the dispersion liquid production process, a water-soluble polymer can be added to the dispersion liquid to further stabilize the droplets dispersed in the dispersion liquid. Specific examples of such a water-soluble polymer include cellulose compounds (e.g., methyl cellulose, ethyl cellulose, hydroxyethyl cellulose, ethylhydroxyethyl cellulose, carboxymethyl cellulose, hydroxypropyl cellulose, and saponified materials of these cellulose compounds), gelatin, starch, dextrin, gum arabic, chitin, chitosan, polyvinyl alcohol, polyvinyl pyrrolidone, polyethylene glycol, polyethyleneimine, polyacrylamide, acrylic acid (or acrylic acid salt) containing polymers (e.g., polyacrylic acid sodium salt, polyacrylic acid potassium salt, polyacrylic acid ammonium salt, materials obtained by partially neutralizing polyacrylic acid with sodium hydroxide, and sodium acrylate-acrylate copolymers), materials obtained by (partially) neutralizing a styrene-maleic anhydride copolymer with sodium hydroxide, water-soluble polyurethane (e.g., reaction products of a polyethylene glycol, polycaprolactone diol or the like with a polyisocyanate), etc.

The toner particle thus prepared in the solvent removal process can be mixed with an external additive to enhance the fluidity, developing property, and charging property of the toner particles. Suitable materials for use as the external additive include particulate inorganic materials. The primary particle diameter of such particulate inorganic materials is preferably from 5 nm to 2 μm, and more preferably from 5 nm to 500 nm. The BET specific surface area of such particulate inorganic materials is preferably from 20 to 500 $m^2/g$. The added amount of such a particulate inorganic material is preferably from 0.01% to 5% by weight of the toner, and more preferably from 0.01% to 2.0% by weight of the toner.

Specific examples of such a particulate inorganic material for use as the external additive include silica, alumina, barium titanate, magnesium titanate, calcium titanate, strontium titanate, zinc oxide, tin oxide, silica sand, clay, mica, wollastonite, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. In addition, particulate polymers, which are prepared by a polymerization method such as soap-free emulsion polymerization, suspension polymerization and dispersion polymerization, such as polystyrene, copolymers of (meth)acrylates, polycondensation polymers such as silicone resins, benzoguanamine resins, and nylon resins, and thermosetting polymers can also be used as the external additive.

When a particulate inorganic material is used as the external additive, the particulate inorganic material is preferably subjected to a surface treatment to prevent deterioration of fluidity and charging property of the toner under high humidity conditions. Specific examples of the treatment agent for use in the surface treatment include silane coupling agents, silylation agents, silane coupling agents having a fluorinated alkyl group, organic titanate coupling agents, aluminum coupling agents, silicone oils, modified silicone oils, etc.

In order to enhance the cleanability of the toner such that particles of the toner remaining on an image bearer such as photoreceptors and intermediate transfer media can be easily removed therefrom by a cleaner, the toner can include a cleanability improving agent. Specific examples of such a cleanability improving agent include fatty acids and metal salts thereof such as zinc stearate, calcium stearate and stearic acid; particulate polymers such as polymethyl methacrylate and polystyrene, which are prepared by a polymerization method such as soap-free emulsion polymerization and which preferably has a relatively narrow particle diameter distribution while having a volume average particle diameter of from 0.01 μm to 1 μm; etc.

The thus prepared toner can be used for a two-component developer by being mixed with a magnetic carrier. The mixing ratio (T/C) of the toner (T) to a carrier (C) is from 1/100 to 10/100 by weight. Suitable materials for use as the magnetic carrier include iron powders, ferrite powders, magnetite powders, and magnetic resin particles, which are conventionally used as carriers and which preferably have a particle size of from 20 μm to 200 μm.

The surface of the magnetic carrier is preferably coated with a resin. Specific examples of such a resin to be coated on the carrier include amino resins (such as urea-formaldehyde resins, melamine resins, benzoguanamine resins, urea resins and polyamide resins), and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins; polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, fluoroterpolymers (such as terpolymers of tetrafluoroethylene, vinylidenefluoride and other monomers including no fluorine atom); and silicone resins can also be used as the resin to be coated on the surface of the magnetic carrier.

If desired, the resin to be coated on the surface of the magnetic carrier can include an electroconductive material such as powders of carbon black, titanium oxide, tin oxide, and zinc oxide. The average particle diameter of such an electroconductive material is preferably not greater than 1 μm. When the average particle diameter is greater than 1 μm, it often becomes difficult to control the electric resistance of the resin layer formed on the surface of the magnetic carrier.

The toner can be used as a one-component developer, which does not include a carrier.

The toner is typically contained in a container such as plastic bottles, bottles having an agitator (such as agitating springs) therein, and process cartridges, and the container is set to an image forming apparatus so that the toner in the container is fed to the developing device of the image forming apparatus.

Next, the dispersion liquid production process will be described in detail.

In a case in which the oil phase liquid includes a toner composition including a binder resin precursor (prepolymer) having an isocyanate group, the prepolymer is reacted with an amine in the aqueous medium, thereby forming resin particles (toner particles). Alternatively, a modified polyester resin may be included in the oil phase liquid instead of the prepolymer. In this case, the modified polyester resin is reacted with an amine in the aqueous medium.

The method for preparing an oil phase liquid in which a toner composition including at least one of a binder resin and a binder resin precursor is dissolved or dispersed in an organic solvent together with a colorant, etc. is not particularly limited, and any known methods can be used therefor. For example, a method including gradually adding a toner composition including a resin, a colorant, etc. to an organic solvent while agitating the mixture to dissolve or disperse the toner composition in the organic solvent is typically used. When a pigment, which is not dissolved in the organic solvent used, and additives such as release agents and charge controlling agents, which are not dissolved in the organic solvent used, are used for the toner composition, it is preferable to subject the materials to a treatment (such as pulverization) so that the materials have a small particle diameter before the materials are added to the organic solvent.

One example of such a treatment is to prepare a master batch of a colorant using the method mentioned above. The master batch method can also be used for the additives such as release agents and charge controlling agents. Alternatively, it is possible to prepare a wet master batch of a colorant, a release agent and/or a charge controlling agent by dispersing the materials in an organic solvent optionally using a dispersant. When a material having a melting point lower than the boiling point of the organic solvent used is dispersed, a method in which the mixture of the material and the organic solvent is heated optionally together with a dispersant to dissolve (melt) the material in the organic solvent, and then the solution is cooled while being agitated or applying a shearing force thereto to prepare a dispersion liquid in which small particles (crystals) of the material are dispersed in the organic solvent can be used.

When such a dispersion liquid of a colorant, a release agent and/or a charge controlling agent is used, the dispersion liquid and the resin component (such as binder resin and/or binder resin precursor) are added to an organic solvent to be dissolved or dispersed in the organic solvent while optionally subjected to a dispersing treatment to prepare an oil phase liquid. When the dispersing treatment is performed, known dispersers such as mixers using an agitator, homogenizers having a high speed rotor and a stator, high pressure homogenizers, and mixers using a medium such as ball mills, bead mills, and sand mills can be used. Toner components such as a colorant, a release agent and a charge controlling agent other than the resin component are not necessarily added to the aqueous medium, and for example the toner components can be mixed with the resultant resin particles (toner particles) in the aqueous medium or after the toner particles are dried. Specifically, resin particles prepared in the aqueous medium can be dyed with a colorant using a known dyeing method.

In the dispersion liquid production process, the aqueous medium, which includes at least an aqueous solvent and a surfactant, and the above-mentioned oil phase liquid are mixed to prepare an emulsion while forming resin particles, thereby producing a dispersion liquid. In this regard, the device used for preparing the dispersion is not particularly limited, and specific examples thereof include low speed shearing dispersers, high speed shearing dispersers, friction dispersers, high pressure jet dispersers, ultrasonic dispersers, etc. When a dispersion liquid of resin particles having an average particle diameter of from 2 μm to 20 μm is prepared, high speed shearing dispersers are preferably used.

Known mixers (such as emulsifiers and dispersers) having a rotating blade are preferably used for mixing the aqueous medium and the oil phase liquid to prepare an emulsion. Specific examples of such mixers include continuous emulsifiers such as ULTRA-TURRAX (from IKA Japan), POLYTRON from KINEMATICA AG, TK HOMOMIXER from PRIMIX Corp., EBARA MILDER from EBARA CORPORATION, TK PIPELINE HOMOMIXER and TK HOMOMIC LINE FLOW from PRIMIX Corp., a colloid mill from KOBELCO ECO-Solutions CO., Ltd., THRASHER and TRIGONAL wet pulverizer from MITSUI MIIKE MACHINERY Co., Ltd. CAVITRON from EUROTECH LTD., and FINE FLOW MILL from Pacific Machinery & Engineering Co., Ltd., and batch or batch and continuous emulsifiers such as CLEARMIX from M TECHNIQUE Co., Ltd., and FILMIX from PRIMIX Corp.

When high speed shearing dispersers are used, the revolution of the rotor is not particularly limited, but is generally from 1,000 to 30,000 rpm, and preferably from 5,000 to 15,000 rpm. The dispersing time is not particularly limited, but is generally from 1 to 5 minutes when batch dispersers are used. When the dispersing time is longer than 5 minutes, problems such that undesired small particles are formed, or aggregates or coarse particles are formed due to excessive dispersing tend to be caused. In contrast, when the dispersing time is shorter than 1 minute, it becomes difficult to obtain particles having good particle diameter evenness, thereby making it impossible to produce toner particles having the desired particle diameter distribution. The dispersing temperature is generally from 0 to 40° C., and preferably from 10 to 30° C. When the dispersing temperature is higher than 40° C., a problem such that the molecules are exited, thereby deteriorating the dispersion stability of the dispersion liquid, resulting in formation of aggregates and coarse particles tends to be caused. In contrast, when the dispersing temperature is lower than 0° C., the viscosity of the dispersion liquid seriously increases, and therefore the shear force applied to satisfactorily disperse the dispersion liquid has to be increased, resulting in deterioration of the manufacturing efficiency.

The dispersion liquid thus prepared in the dispersion liquid production process is then subjected to the solvent removal process. In the solvent removal process, the dispersion liquid is placed under a reduced pressure condition to accelerate evaporation of the organic solvent from the dispersion liquid. Thus, almost all the organic solvent can be removed from the dispersion liquid, thereby producing a particulate toner precursor. The particulate toner precursor is dried by a drier such as flash driers, circulation driers, reduced-pressure driers, and vibro-fluidizing driers, thereby producing a powdery toner. In this regard, it is preferable that the moisture included in the powdery toner is less than 1% by weight. The powdery toner may be subjected to centrifugal separation to remove fine particles therefrom, or classification using a classifier to produce a toner having the desired particle diameter distribution.

As mentioned above, an external additive can be added to the powdery toner (dry toner particles). In this regard, by applying a mechanical impact force to the mixture of the powdery toner and the external additive, the external additive can be fixed to the surface of the powdery toner (i.e., the external additive and the powdery toner are integrated), and thereby the external additive can be prevented from releasing from the powdery toner. Specific examples of the method of applying a mechanical impact force include a method in which a mechanical impact force is applied to the mixture by a blade rotated at a high speed; and a method in which the mixture is fed into a high speed airflow so that the particles of the external additive and the powdery toner collide with each other or the combined particles of the external additive and the powdery toner collide with a collision plate. Specific examples of the device to apply a mechanical impact force include NOBILTA from Hosokawa Micron Corp., METEORAINBOW from Nippon Pneumatic Mfg. Co., Ltd., and HYBRIDIZATION SYSTEM from Nara Machinery Co., Ltd.

Next, a conventional batch toner producing apparatus will be described by reference to FIG. 1.

FIG. 1 is a schematic view illustrating a solvent removing device 350 of a conventional batch toner producing apparatus. Referring to FIG. 1, the solvent removing device 350 includes an agitating tank 351, an agitator 353, a gas-liquid separator 355, a suction pump 356, a condensation and collection tank 357, a concentrated liquid transfer pump 358, etc. The agitating tank 351 is connected with a storage tank (not shown) via a pipe. A large amount of dispersion liquid, which includes resin particles and an organic solvent and which is prepared by a dispersion liquid producing device (not shown), is stored in the storage tank. In this regard, the dispersion liquid stored in the storage tank is transferred little by little to the agitating tank 351 of the solvent removing device 350 as illustrated by an arrow C.

The agitator 353 agitates the dispersion liquid in the agitating tank 351 by rotating a blade fixed to the tip of an agitating shaft of the agitator. A transfer pipe is connected with the upper wall of the agitating tank 351, and the gas-liquid separator 355 is connected with the other end of the transfer pipe. In addition, the suction pump 356, which is a vacuum pump, and the condensation and collection tank 357 are connected with the gas-liquid separator 355.

The suction pump 356 strongly sucks the dispersion liquid in the agitating tank 351 and the organic solvent evaporated from the dispersion liquid via the gas-liquid separator 355. Due to this suction, the pressure of the dispersion liquid in the agitating tank 351 is reduced to a pressure lower than the atmospheric pressure so that solvent removal can be efficiently performed (i.e., removal of the organic solvent from the dispersion liquid can be accelerated). The gas of the organic solvent in the dispersion liquid, which is transferred to the gas-liquid separator 355 by the suction of the suction pump 356, is liquefied in the gas-liquid separator 355 to be collected. Since the organic solvent gas is thus collected, the dispersion liquid in the agitating tank 351 is concentrated.

The concentrated dispersion liquid in the condensation and collection tank 357 is transferred to a washing and drying device (not shown) by the driving force of the concentrated liquid transfer pump 358.

Transfer of the dispersion liquid from the storage tank (not shown) to the agitating tank 351 is performed using the pressure difference between the pressure in the storage tank and the pressure in the agitating tank 351. Specifically, when the suction pump 356 is operated, the pressure of the dispersion liquid in the agitating tank 351 becomes a negative pressure. In contrast, the pressure of the dispersion liquid in the storage tank is maintained at the atmospheric pressure. Due to the pressure difference between the negative pressure and the atmospheric pressure, the dispersion liquid in the storage tank is sucked so as to be fed to the agitating tank 351, resulting in transfer of the dispersion liquid.

The batch toner producing apparatus has a merit such that production of the dispersion liquid in a dispersion liquid producing device (not shown) and removal of solvent from the dispersion liquid in the solvent removing device 350 can be independently controlled, and therefore maintenance of the batch toner producing apparatus can be easily performed.

If desired, pure water can be fed into the agitating tank 351 as illustrated by an arrow D using a supply pump, and a defoaming agent can be fed into the agitating tank 351 as illustrated by an arrow E using a supply pump. Since each of the supply pumps is a closed pump, pure water and the defoaming agent present on the upstream side from the pumps are not sucked by the negative pressure in the agitating tank 351.

Next, a conventional continuous toner producing apparatus will be described by reference to FIG. 2.

Figure 2:
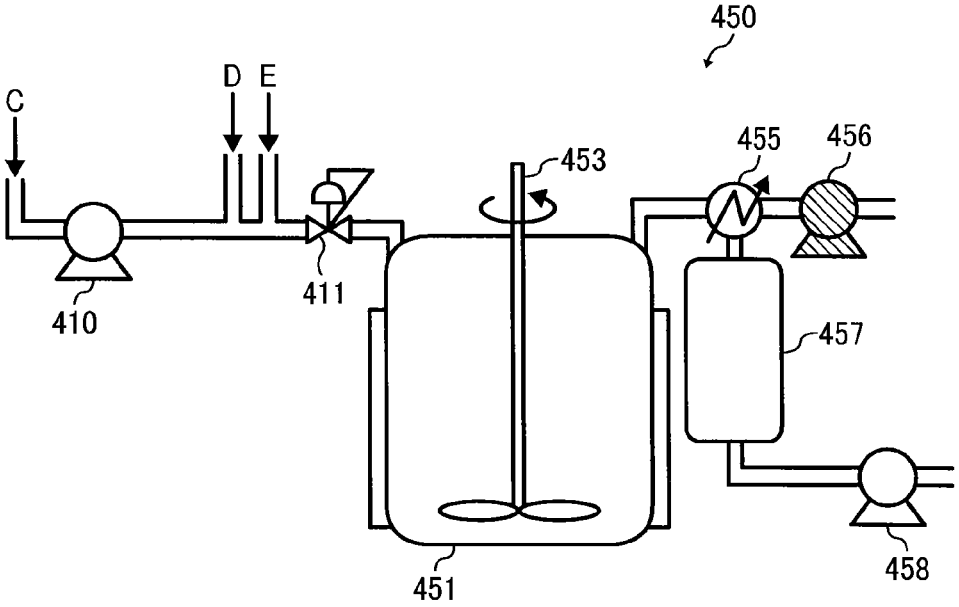
FIG. 2 RELATED ART
FIG. 2 is a schematic view illustrating a solvent removing device of a conventional continuous toner producing apparatus.

FIG. 2 is a schematic view illustrating a solvent removing device 450 of a conventional continuous toner producing apparatus. Referring to FIG. 2, the solvent removing device 450 includes an agitating tank 451, an agitator 453, a gas-liquid separator 455, a suction pump 456, a condensation and collection tank 457, a concentrated liquid transfer pump 458, etc. The functions of the agitating tank 451, the agitator 453, the gas-liquid separator 455, the suction pump 456, the condensation and collection tank 457, and the concentrated liquid transfer pump 458 are the same as those of the agitating tank 351, the agitator 353, the gas-liquid separator 355, the suction pump 356, the condensation and collection tank 357, and the concentrated liquid transfer pump 358 mentioned above by reference to FIG. 1.

On the upstream side from the solvent removing device 450, a squeeze pump 410 and a back pressure valve 411 serving as a pressure reducing valve are arranged. The squeeze pump 410 is connected with a dispersion liquid producing device (not shown). In the dispersion liquid producing device, the inner pressure is maintained at a pressure higher than the atmospheric pressure so that resin particles are efficiently produced in an emulsified liquid, which is a precursor of the dispersion liquid.

When the squeeze pump 410 is operated, the dispersion liquid in the dispersion liquid producing device is sucked as illustrated by an arrow C so as to be fed to the back pressure valve 411. The dispersion liquid fed by the squeeze pump 410 is pressed in a pipe connecting the exit of the squeeze pump 410 and the back pressure valve 411 at a pressure slightly higher than the pressure in the dispersion liquid producing device. In contrast, the pressure in the agitating tank 451 of the solvent removing device 450 is maintained at a negative pressure as mentioned above.

The back pressure valve 411 automatically opens the valve when the pressure of the dispersion liquid fed by the squeeze pump 410 becomes greater than a predetermined threshold while automatically closing the valve when the pressure of the dispersion liquid decreases to the threshold. Therefore, the pressure of the dispersion liquid present between the squeeze pump 410 and the back pressure valve 411 is maintained at a pressure slightly higher than the pressure in the dispersion liquid producing device. The pressure in the dispersion liquid producing device is maintained at the high pressure regardless of whether or not the squeeze pump 410 is operated.

It is not necessary for the continuous toner producing apparatus to arrange a storage tank between the dispersing liquid producing device and the solvent removing device 450, and therefore it is possible to save the space of the toner producing apparatus. Similarly to the toner producing apparatus illustrated in FIG. 1, pure water can be fed into the agitating tank 451 as illustrated by an arrow D by a supply pump, and a defoaming agent can be fed into the agitating tank 451 as illustrated by an arrow E by a supply pump, if desired.

The present inventors made a batch toner producing apparatus having the solvent removing device 350 illustrated in FIG. 1, and a continuous toner producing apparatus having the solvent removing device 450 illustrated in FIG. 2, and produced toners using the batch toner producing apparatus and the continuous toner producing apparatus while measuring the particle diameter distribution of each of the toners. As a result, it was found that the particle diameter distribution of the toner produced by the continuous toner producing apparatus is sharper than that of the toner produced by the batch toner producing apparatus. In addition, it was found that in the batch toner producing apparatus, as the storage time of the dispersion liquid in the storage tank increases, the average particle diameter of the toner increases while the particle diameter distribution of the toner broadens.

In addition, the present inventors made various experiments to narrow the particle diameter distribution of the toner produced by the continuous toner producing apparatus. As a result, it was found that the pressure difference between the pressure of the dispersion liquid in the dispersion liquid producing device and the pressure of the dispersion liquid in the solvent removing device 450 prevents narrowing of the particle diameter distribution of the toner. Specifically, in the toner producing apparatus illustrated in FIG, 2, the pressure of the dispersion liquid present between the squeeze pump 410 and the back pressure valve 411 is maintained at a high pressure. In contrast, the pressure of the dispersion liquid present on the downstream side from the back pressure valve 411 is maintained at a negative pressure. Therefore, when the back pressure valve 411 is opened, the dispersion liquid present between the squeeze pump 410 and the back pressure valve 411, which has a high pressure, is sucked vigorously by the negative pressure, and thereby the dispersion liquid is fed at a very high speed through the pipe connecting the back pressure valve 411 and the agitating tank 451. In this case, the particles (toner particles) in the dispersion liquid collide at a high speed with the inner wall of the pipe, and thereby the particles are finely pulverized or united, resulting in broadening of the particle diameter distribution of the toner.

Next, the toner producing apparatus of this disclosure will be described.

Figure 3:
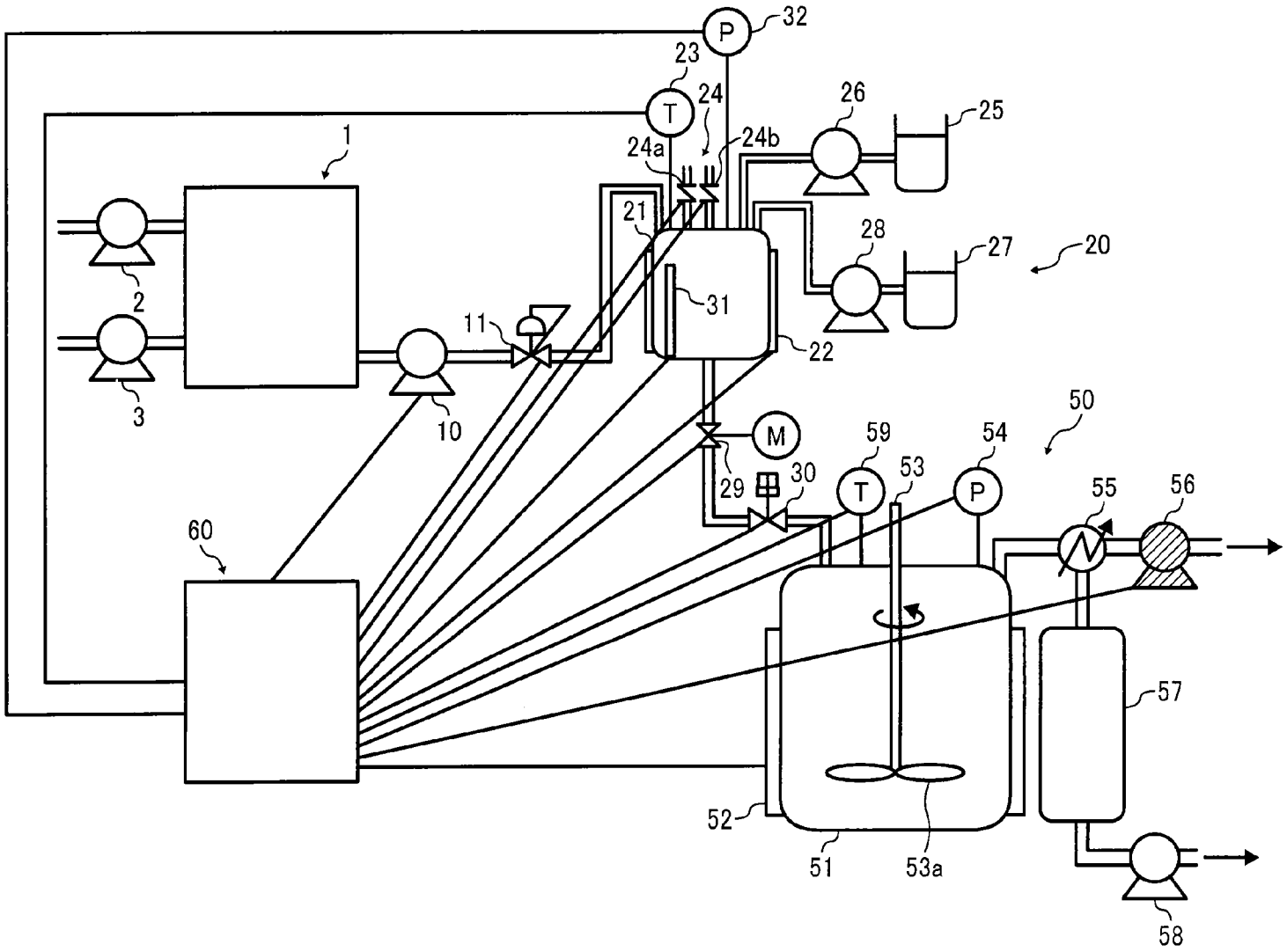
FIG. 3 is a schematic view illustrating a toner producing apparatus according to an embodiment.

FIG. 3 is a schematic view illustrating an example of the toner producing apparatus of this disclosure. Referring to FIG. 3, the toner producing apparatus includes a dispersion liquid producing device 1, a squeeze pump 10, a back pressure valve 11 serving as a decompression valve, and a storage equipment 20 (hereinafter referred to as a storage), which are described above by reference to the conventional toner producing apparatuses. In addition, the toner producing apparatus includes a solvent removing device 50 performing the solvent removal process mentioned above, a controller 60 (such as CPUs) to control devices of the toner producing apparatus, etc.

The dispersion liquid producing device 1 includes a mixed liquid tank to store the oil phase liquid mentioned above, and a mixture of the oil phase liquid and the aqueous solvent (i.e., a liquid in which droplets including a resin component are dispersed in the aqueous solvent). Specifically, in the mixed liquid tank, the oil phase liquid and the aqueous solvent are mixed to prepare a liquid (emulsified liquid or dispersion liquid) in which droplets including a resin component are dispersed in the aqueous solvent, followed by an optional granulation process. Thus, the dispersion liquid to be fed to the storage 20 is prepared. The mixed liquid tank is a closed container. Since the oil phase liquid and the aqueous solvent are pressure-transported (i.e., transported while applying pressure thereto) to the mixed liquid tank, the liquid in the mixed liquid tank is pressed at a pressure higher than the atmospheric pressure. Namely, in the toner producing apparatus of this disclosure, a squeeze pump 2 to pressure-transport the oil phase liquid to the mixed liquid tank, and a squeeze pump 3 to pressure-transport the aqueous solvent to the mixed liquid tank serve as a pressing device to press the dispersion liquid in the dispersion liquid producing device 1 so that the pressure of the dispersion liquid is higher than the atmospheric pressure.

The bottom of the mixed liquid tank of the dispersion liquid producing device 1 is connected with the squeeze pump 10, and the back pressure valve 11. The squeeze pump 10 pressure-transports the dispersion liquid in the mixed liquid tank to the storage 20 mentioned below. The dispersion liquid fed by the squeeze pump 10 is pressed in the pipe connecting the exit of the squeeze pump 10 and the back pressure valve 11 at a pressure slightly higher than the pressure in the mixed liquid tank (hereinafter referred to as a production-time pressure $P_A$ of the dispersion liquid at the time when the dispersion liquid is produced). Hereinafter, the pressure of the dispersion liquid in the pipe connecting the exit of the squeeze pump 10 and the back pressure valve 11 is referred to as an outlet pressure $P_B$.

The back pressure valve 11 automatically opens the valve when the outlet pressure $P_B$ exceeds the predetermined threshold while automatically closing the valve when the outlet pressure $P_B$ decreases to the predetermined threshold. Therefore, the outlet pressure $P_B$ is maintained so as to fall in a range of from a pressure slightly higher than the pressure at the production time $P_A$ and the threshold.

In the toner producing apparatus of this disclosure, a passage of from a pipe connected to the bottom of the mixed liquid tank of the dispersion liquid producing device 1 to the below-mentioned solvent removing device 50 via the squeeze pump 10 and the back pressure valve 11 serves as a liquid feeding passage. The dispersion liquid passing through the back pressure valve 11 in the liquid feeding passage is fed to the storage 20 via a pipe.

The storage 20 includes a storage tank 21, a heater 22, a temperature sensor 23, a pressure adjuster 24, a pure water tank 25, a pure water supply pump 26, a defoaming agent tank 27, a defoaming agent supply pump 28, a stop valve 29, an opening adjustable valve 30, a liquid level sensor 31, etc. The dispersion liquid passing through the back pressure valve 11 is temporarily stored in the storage tank 21. The heater 22 is set on the outer surface of the storage tank 21 to heat the dispersion liquid in the storage tank 21 via the wall of the storage tank 21.

The temperature sensor 23 detects the temperature of the dispersion liquid in the storage tank 21, and sends the data to the controller 60 of the toner producing apparatus. In addition, the liquid level sensor 31 detects the level of the dispersion liquid in the storage tank 21, and sends the data to the controller 60.

The pressure adjuster 24 includes an inflow valve 24a connected with the upper wall of the storage tank 21, and an outflow valve 24b connected with the upper wall of the storage tank 21. The inflow valve 24*a* is a check valve which permits a gas to flow in only one direction of from the outside of the storage tank 21 to the inside thereof. The inflow valve 24*a* automatically opens only when the pressure in the storage tank 21 becomes not higher than a predetermined lower limit. A gas tank (not shown) storing an inert gas such as nitrogen gas is connected with the entrance of the inflow valve 24*a*. Therefore, when the pressure in the storage tank 21 becomes not higher than the predetermined lower limit and the inflow valve 24*a* opens, the inert gas in the gas tank inflows into the storage tank 21, thereby increasing the pressure in the storage tank 21. In this regard, when the pressure in the storage tank 21 increases to a pressure lower than the lower limit, the inflow valve 24*a* closes.

The outflow valve 24*b* is a check valve which permits a gas to flow in only one direction of from the inside of the storage tank 21 to the outside thereof The outflow valve 24*b* automatically opens only when the pressure in the storage tank 21 becomes not lower than a predetermined upper limit. Therefore, when the pressure in the storage tank 21 becomes not lower than the predetermined upper limit and the outflow valve 24*b* opens, the gas in the gas tank outflows from the storage tank 21, thereby decreasing the pressure in the storage tank 21. In this regard, when the pressure in the storage tank 21 decreases to a pressure lower than the upper limit, the outflow valve 24*b* closes.

By thus operating the inflow valve 24*a* and the outflow valve 24*b*, the pressure in the storage tank 21 can be maintained in a predetermined range. Hereinafter, the pressure of the dispersion liquid or the gas in the storage tank 21 is referred to as an in-tank pressure Pc.

The pure water supply pump 26 supplies pure water stored in the pure water tank 25 to the storage tank 21. In addition, the defoaming agent supply pump 28 supplies the defoaming agent stored in the defoaming agent tank 27 to the storage tank 21.

A discharge pipe is connected with the bottom of the storage tank 21, and the stop valve 29 is connected with the discharge pipe. The stop valve 29 includes a motor valve, which is opened or closed by a driving force of a motor. The stop valve 29 may be an electromagnetic valve instead of the motor valve.

The dispersion liquid in the storage tank 21 is fed to the below-mentioned solvent removing device 50 by utilizing the pressure difference between the pressure in the storage tank 21 and the pressure in the solvent removing device 50. Specifically, the in-tank pressure Pc is maintained at a pressure higher than the pressure in the solvent removing device 50 by the pressure adjuster 24. Therefore, when the stop valve 29 is opened, the dispersion liquid in the storage tank 21 is fed to the solvent removing device 50 due to the pressure difference. The opening adjustable valve 30 is arranged between the stop valve 29 and the solvent removing device 50, and sets the degree of opening of the valve to a predetermined value. When the stop valve 29 is fully opened, the flow speed of the dispersion liquid flowed due to the pressure difference is controlled so as to be a value determined depending on the degree of opening of the opening adjustable valve 30. Thus, the opening adjustable valve 30 functions to adjust the flow speed of the dispersion liquid flowing from the storage tank 21 to the solvent removing device 50.

The solvent removing device 50 includes an agitating tank 51, a heater 52, an agitator 53, a pressure sensor 54, a gas-liquid separator 55, a suction pump 56, a condensation and collection tank 57, a concentrated liquid transfer pump 58, etc. The dispersion liquid fed from the storage tank 21 of the storage 20 flows into the agitating tank 51 of the solvent removing device 50 after passing through the stop valve 29 and the opening adjustable valve 30, and is temporarily stored in the agitating tank 51.

The agitator 53 agitates the dispersion liquid in the agitating tank 51 by rotating a rotatable blade 53*a* fixed to the tip of an agitating shaft thereof. In addition, the pressure sensor 54 detects the pressure of the gas in the agitating tank 51, and sends the data to the controller 60 of the toner producing apparatus.

A transfer pipe is connected with the upper wall of the agitating tank 51, and the lower end of the transfer pipe is connected with the gas-liquid separator 55. The gas-liquid separator 55 is connected with the suction pump 56, which is a vacuum pump, and the condensation and collection tank 57.

The suction pump 56 strongly sucks the dispersion liquid in the agitating tank 51 and the gas of the organic solvent evaporated from the dispersion liquid. Due to this sucking, the pressure of the dispersion liquid in the agitating tank 51 decreases to a pressure lower than the atmospheric pressure. Therefore, evaporation of the organic solvent from the dispersion liquid is accelerated. The mixture fluid of the dispersion liquid and the gas of the organic solvent transferred to the gas-liquid separator 55 by the suction pump 56 is separated into a concentrated liquid including toner particles at a high concentration and the organic solvent gas in the gas-liquid separator 55. The organic solvent gas is collected in a solvent collection tank (not shown), which is connected with the suction pump 56, after passing through the inside of the suction pump 56. Since the pressure of the organic solvent is increased to the atmospheric pressure in the solvent collection tank, the organic solvent gas is returned to the organic solvent liquid. Hereinafter, the pressure of the dispersion liquid or the organic solvent gas in the agitating tank 51 of the solvent removing device 50 is referred to as a solvent-removal-time pressure $P_D$.

The concentrated dispersion liquid separated by the gas-liquid separator 55 drops into the condensation and collection tank 57 by its own gravity. The pressure in the condensation and collection tank 57 is maintained at a pressure substantially equal to the atmospheric pressure. The concentrated dispersion liquid in the condensation and collection tank 57 is fed to a washing and drying device (not shown) by the concentrated liquid transfer pump 58.

The production-time pressure $P_A$ of the dispersion liquid in the mixed liquid tank of the dispersion liquid producing device 1 is set, for example, in a range of from 20 to 80 kPa. The outlet pressure $P_B$ of the dispersion liquid present in the pipe between the squeeze pump 10 and the back pressure valve 11 is maintained in a range of from 150 to 200 kPa when the dispersion liquid is pressure-transported. These pressures $P_A$ and $P_B$ are similar to those in conventional continuous toner producing apparatuses.

The solvent-removal-time pressure $P_D$ of the dispersion liquid or the organic solvent gas in the agitating tank 51 of the solvent removing device 50 is set in a range of from −40 to −98 kPa, which is similar to that in conventional continuous toner producing apparatuses. Namely, the range of the solvent-removal-time pressure $P_D$ is similar to the pressure range in conventional solvent removing devices performing solvent removal under a reduced pressure. In this regard, in order to efficiently remove a solvent under a reduced pressure, the pressure is preferably in the range mentioned above although the pressure range changes depending on the solvent used. When removing ethyl acetate at a relatively low temperature, the solvent-removal-time pressure $P_D$ is preferably from −80 to −98 kPa. In order to stably perform the solvent removal process while stably evaporating the organic solvent, it is preferable to control the solvent-removal-time pressure $P_D$ within ±5 kPa of the targeted pressure, and more preferably ±2 kPa of the targeted pressure. Specifically, when the targeted pressure of the solvent-removal-time pressure $P_D$ is −90 kPa, the pressure is preferably controlled in a range of from −85 to −95 kPa, and more preferably from 88 to 92 kPa.

Conventional continuous toner producing apparatuses are not equipped with the storage 20 of the toner producing apparatus of this disclosure illustrated in FIG. 3. The in-tank pressure $P_C$, which is the pressure of the dispersion liquid in the storage tank 21 of the storage 20, is maintained by the pressure adjuster 24 so as to fall in a range of from −5 to 20 kPa. The in-tank pressure $P_C$ is a pressure between the outlet pressure $P_B$ and the solvent-removal-time pressure $P_D$. The in-tank pressure $P_C$ is preferably from −2 to 10 kPa.

In the above-mentioned conventional continuous toner producing apparatus illustrated in FIG. 2, the pressure difference (hereinafter referred to as conventional pressure difference) between the pressure at the entrance of the back pressure valve 411 and the pressure at the exit thereof is represented by the following equation when the back pressure valve 411 opens:

$$\text{Conventional pressure difference} = \text{outlet pressure } P_B - \text{solvent-removal-time pressure } P_D.$$

In contrast, in the toner producing apparatus of this disclosure illustrated in FIG. 3, the pressure difference (hereinafter referred to as improved pressure) between the pressure at the entrance of the back pressure valve 11 and the pressure at the exit thereof is represented by the following equation when the back pressure valve 11 opens:

Improved pressure difference=outlet pressure $P_B$−in-tank pressure $P_C$.

Since the in-tank pressure $P_C$ is a pressure between the production-time pressure $P_A$, which is slightly lower than the outlet pressure $P_B$, and the solvent-removal-time pressure $P_D$, which is a negative pressure, the improved pressure difference is smaller than the conventional pressure difference. By thus decreasing the pressure difference, the speed of the dispersion liquid flowing through the pipe connecting the back pressure valve 11 with the storage tank 21 can be decreased, and thereby the stress to the dispersion liquid in the pipe can be reduced. By thus reducing the stress, occurrence of pulverization and uniting of resin particles (toner particles) in the dispersion liquid can be prevented, thereby making it possible to prevent broadening of the particle diameter distribution of the toner.

The controller 60 closes the stop valve 29 when the liquid level sensor 31 detects that the level of the dispersion liquid in the storage tank 21 becomes not higher than the lower limit of the level.

In addition, the controller 60 opens the stop valve 29 when the liquid level sensor 31 detects that the level of the dispersion liquid in the storage tank 21 becomes higher than the lower limit of the level.

The controller 60 can perform the following controlling instead of the above-mentioned liquid level controlling. Specifically, when the liquid level sensor 31 detects that the level of the dispersion in the storage tank 21 becomes not lower than the upper limit, the controller stops the squeeze pump 11, and when the liquid level sensor 31 detects that the level of the dispersion in the storage tank 21 becomes lower than the upper limit of the level, the controller operates the squeeze pump 11.

By performing such controlling, the process of producing the dispersion liquid and the solvent removal process can be properly performed without idling the dispersion liquid producing device and the solvent removing device even if the dispersion producing speed is not proportional to the solvent removing speed.

In addition, instead of supply of pure water using the pure water supply pump 26, materials used for the dispersion production process, etc., such as functionality imparting agents, may be supplied. When pure water is supplied, the added amount of pure water is preferably not greater than 50% by weight, and more preferably not greater than 30% by weight, based on the weight of the dispersion liquid, from the viewpoint of the surface property, the thermal property and the productivity of the resultant resin particles.

In order to prevent agglomeration of the resin particles in the dispersion liquid, the concentration of the organic solvent in the dispersion liquid contained in the storage tank 21 is preferably decreased so as to be not higher than 15.0% by weight, more preferably not higher than 12.5% by weight, and even more preferably not higher than 10% by weight. Even when the concentration of the organic solvent is decreased to a concentration out of the above-mentioned range, a certain level of effect can be produced compared to a case in which the solvent concentration is maintained. However, it is preferable to control the solvent concentration in the above-mentioned range to stably produce toner particles having a sharp particle diameter distribution regardless of the scale of the toner producing apparatus.

By supplying pure water to the storage tank 21 using the pure water supply pump 26, the concentration of the organic solvent and the concentration of the resin particles in the dispersion liquid can be decreased. In the toner producing apparatus of this disclosure, the controller 60 properly adjusts the amount of driving (such as rotation speed) of the suction pump 56 so that the concentration of the organic solvent in the dispersion liquid is decreased so as to be not higher than 15.0% by weight. Specifically, the controller 60 adjusts the amount of driving of the suction pump 56 so that the pressure of the dispersion liquid in the agitating tank 51 and the pressure of the organic solvent gas in the agitating tank 51, which are detected by the pressure sensor 54, fall in predetermined ranges. By performing such controlling, the pressure of the dispersion liquid in the agitating tank 51 and the pressure of the organic solvent gas in the agitating tank 51 can be maintained so as to fall in the predetermined ranges as long as the a proper amount of dispersion liquid is present in the storage tank 21 and the suction pump 56 is operated. In this case, the temperature of the dispersion liquid in the agitating tank 51 can be stabilized and the amount of organic solvent evaporating from the dispersion liquid can be properly controlled, and thereby the concentration of the organic solvent can be decreased so as to be not higher than 15.0% by weight.

When the temperature of the dispersion liquid in the storage tank 21 is different from the targeted temperature, the temperature of the dispersion liquid in the agitating tank 51 becomes different from the targeted temperature even if the pressure in the agitating tank 51 is maintained so as to fall in the predetermined range, thereby making it possible for the concentration of the organic solvent in the dispersion liquid to exceed 15.0% by weight. Therefore, the controller 60 performs on-off controlling on the heater 22 serving as a heating device so that the temperature of the dispersion liquid in the storage tank 21, which is detected by the temperature sensor 23, falls in a predetermined range, thereby making it possible to control the temperature of the dispersion in the storage tank 21 so as to fall in the predetermined range.

In addition, the controller 60 performs on-off controlling on the heater 52 serving as a heating device so that the temperature in the agitating tank 51, which is detected by a temperature sensor 59, falls in a predetermined range. In this regard, the targeted temperature in the agitating tank 51 is higher than the targeted temperature in the storage tank 21 of the storage 20. Namely, the controller 60 performs on-off controlling on the heater 52 so that the temperature of the dispersion liquid in the agitating tank 51 falls in a predetermined temperature range higher than the temperature of the dispersion liquid in the storage tank 21. The reason therefor is the following. Specifically, when a dispersion liquid which includes the organic solvent at a relatively high concentration is heated at a relatively high temperature, a trouble tends to be caused due to rapid evaporation of the organic solvent. Therefore, in the storage tank 21, which stores the dispersion liquid including the organic solvent at a relatively high concentration, the heating temperature for the dispersion liquid in the storage tank 21 has to be set to a relatively low temperature. In contrast, since a large amount of organic solvent has evaporated from the dispersion liquid in the agitating tank 51 due to reduction of pressure, the concentration of the organic solvent in the dispersion liquid contained in the agitating tank 51 is lower than the concentration of the organic solvent in the dispersion liquid contained in the storage tank 21. Therefore, the heating temperature for the dispersion liquid in the agitating tank 51 can be set to a temperature higher than the heating temperature for the dispersion liquid in the storage tank 21.

By heightening the heating temperature, i.e., by heightening the temperature of the dispersion liquid, the efficiency of evaporation of the organic solvent from the dispersion liquid can be further enhanced.

By thus performing controlling of the temperature of the dispersion liquid in the storage tank 21, controlling of the temperature of the dispersion liquid in the agitating tank 51, and controlling of the pressure in the agitating tank 51 (i.e., controlling of the driving amount of the suction pump 56), the concentration of the organic solvent in the dispersion liquid contained in the agitating tank 51 can be precisely controlled.

It is possible that after the dispersion liquid is subjected to a continuous solvent removing treatment, the dispersion liquid may be subjected to a known solvent removal treatment accompanied with heating and/or decompression to reduce the amounts of odor generation materials (such as residual monomers and low-volatile materials), decomposition products of the reaction initiator used, and residual solvents.

The temperature (t) of the dispersion liquid in the storage tank 21 is preferably controlled so as to fall in a range of from 5° C. to a temperature 10° C. lower than the glass transition temperature (Tg) of the binder resin of the resin particles (toner particles) so that the resin particles in the dispersion liquid are prevented from agglomerating, thereby preventing broadening of the particle diameter distribution of the resin particles. In addition, when the dispersion liquid is heated by the heater 22, problems such that the surface of the resin particles is softened and thereby the surface area of the resin particles is decreased; and the efficiency of solvent removal is deteriorated due to adherence of the resin particles are caused. Therefore, it is preferable to control the upper limit of the temperature (t) of the dispersion liquid in the storage tank 21 at the temperature 10° C. lower than the glass transition temperature (Tg) of the binder resin of the resin particles.

When the temperature (t) of the dispersion liquid in the storage tank 21 is lower than 5° C., a large-size condensing device or a large amount of energy is necessary for condensing the vaporized organic solvent. Therefore, the lower limit of the temperature (t) of the dispersion liquid in the storage tank 21 is preferably 5° C. The lower limit is more preferably 10° C., and even more preferably 15° C.

In the toner producing apparatus of this disclosure, it is preferable to supply a defoaming agent to the dispersion liquid in the storage tank 21 using the deforming agent supply pump 28 so that the dispersion liquid is prevented from foaming with less manufacturing-environment load and without complicating the toner manufacturing process. Any known defoaming agents can be used as the defoaming agent. Among various defoaming agents, organic materials, which include a silicone, a surfactant, a polyether, a higher alcohol or the like, are preferable because of having good defoaming ability. Particularly, materials including a silicone are preferable because of having an immediate effect. Defoaming agents are broadly classified into oil type deforming agents, oil compound type deforming agents, solution type defoaming agents, powder type defoaming agents, emulsion type defoaming agents, and self-emulsification type defoaming agents, and it is preferable to choose a proper defoaming agent from these defoaming agents depending on the composition of the dispersion liquid. In this regard, the controller 60 may adjust the driving amount of the defoaming agent supply pump 28 based on the result of detection of the degree of defoaming of the dispersion liquid in the storage tank using a sensor. By performing such controlling, the amount of defoaming agent can be saved by preventing wasteful use of the defoaming agent.

The amount of defoaming agent remaining in toner is determined as follows.

Specifically, the amount of the defoaming agent remaining in toner was determined using a gas chromatography equipment GC-2010 from Shimadzu Corporation. Specifically, each of the defoaming agent and the toner were subjected to gas chromatography and the peaks thereof were compared to determine the amount of volatile organic compounds (VOC) of the defoaming agent in the toner. For example, when a modified silicone compound including octamethyltetrasiloxane (D4) is used as the defoaming agent, the measurement method is the following.

Specifically, 1.5 g of a sample (toner or defoaming agent), and 10 ml of an internal standard liquid, which had been prepared by adding 1.00 g of toluene to a 500 ml measuring flask and then adding dimethylformamide (DMF) so that the total volume of the mixture solvent becomes 500 ml, were fed into a 50 ml screw vial. Further, DMF was added to the mixture so that the mixture has a volume of 50 ml, followed by agitating the mixture, resulting in formation of a measurement sample. When part of the components of the defoaming agent was not perfectly dissolved in the solvent, the sample was filtered so as to be available for measurement. The measurement sample was fed into a 1.5 ml screw vial using a clean pipette, and the screw vial was set to the gas chromatography equipment to determine the amount of the component (octamethyltetrasiloxane (D4)).

The measuring conditions were as follows.

Mode of injecting the sample into the vaporing chamber: Sprit

Temperature in the vaporing chamber: 180° C.

Carrier gas used: He

Pressure: 40.2 kPa

Total flow: 56.0 ml/min

Column flow: 1.04 ml/min

Linear speed: 20.0 cm/sec

Purge flow: 3.0 ml/min

Sprit ratio: 50.0

Name of the column: ZB-50

Thickness of liquid phase: 0.25 μm

Length of the column: 30.0 m

Inside diameter of the column: 0.32 mm

ID column upper limit: 340° C.

Open column temperature: 70° C.

Temperature changing program: 70° C. (held for 6 minutes)→heating at a temperature rising speed of 60° C./min 230° C. (held for 5 minutes)

Temperature detected by the detector: 250° C.

Makeup gas used: $N_2$/Air

Makeup gas flow: 30.0 ml/min $N_2$ flow: 47.0 ml/min

Air flow: 400 ml/min

The amount of D4 remaining in the toner is preferably not greater than 30 ppm, and more preferably not greater than 10 ppm.

The concentrated dispersion liquid obtained by removing the organic solvent from the dispersion liquid by the solvent removing device 50 is fed to an aging device or a drying device (not shown). For example, when a prepolymer having an isocyanate group at the end thereof is used for forming the resin particles, the aging device performs a treatment of accelerating the polymer chain growth reaction or crosslinking reaction of the isocyanate group of the resin particles. The aging time is generally from 1 hour to 12 hours, and preferably from 3 hours to 10 hours. The aging (reaction) temperature is generally from 25 to 65° C., and preferably from 35 to 55° C.

The toner producing apparatus of this disclosure can further include a washing device to wash the resin particles (toner particles) included in the concentrated dispersion liquid, which has been subjected to the aging device. In the concentrated liquid, which includes the aqueous solvent, toner particles are dispersed in the aqueous solvent. Known washing technologies can be used for washing toner particles in such a concentrated dispersion liquid. In an example of the washing device of the toner producing apparatus of this disclosure, the concentrated dispersion liquid is initially washed and dehydrated by a filter press, and then the resultant toner cake is dispersed in ion-exchange water having a temperature of form room temperature to about 40° C. to prepare a toner dispersion liquid including the toner particles. In the filtering process, the pH of the dispersion liquid is preferably adjusted so as to fall in a range of from 3.0 to 6.0 to efficiently remove residual raw materials (impurities) such as dispersants from the dispersion liquid. In this regard, when the pH is lower than 3.0, a problem in that the impurities precipitate in the dispersion liquid tends to occur. In contrast, when the pH is higher than 6.0, it becomes difficult to efficiently remove the impurities. The washing treatment using a filter press can be repeated several times. When a charge controlling agent is used for the toner, the charge controlling agent is preferably added to the toner particles after the toner particles are subjected to the washing treatment using the filter press.

Any known drying methods can be used for drying the washed toner particles. For example, a drying method in which the toner dispersion liquid is dehydrated by a centrifugal separator to obtain a toner cake, and the toner cake is dried by airflow at a temperature of from 30 to 70° C. in a flash drier to prepare dry toner particles.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The experiments that the present inventors made will be described.

The present inventors provided a prototype of a conventional batch toner producing apparatus equipped with the solvent removing device 350 illustrated in FIG. 1, a prototype of a conventional continuous toner producing apparatus equipped with the solvent removing device 450 illustrated in FIG. 2, and a prototype of the toner producing apparatus of this disclosure illustrated in FIG. 3, and produced toners using the apparatuses while measuring the below-mentioned properties (such as particle diameter distribution) of the toners.

The molecular weight of each toner was measured by GPC (gel permeation chromatography) under the following conditions.

(1) Instrument used: GPC-150C from Waters Corp.
(2) Column used: SHODEX KF801-807 from SHOWA DENKO K.K.
(3) Temperature: 40° C.
(4) Solvent used: Tetrahydrofuran (THF)
(5) Flow rate: 1.0 ml/min
(6) Sample: 0.1 ml of a THF solution including a sample (toner) at a concentration of 0.05 to 0.6% by weight is injected into the instrument.

The number average molecular weight and the weight average molecular weight of the toner were calculated based on the measured molecular weight distribution of the toner and a molecular weight calibration curve prepared by using mono-disperse polystyrene standard samples.

In this regard, SHODEX STANDARD Nos. S-7300, S-210, S-390, S-875, S-1980, S-10.9, S-629, S-3.0 and S-0.580 from SHOWA DENKO K.K. were used as the mono-disperse polystyrene standard samples. In this case, toluene was used as the solvent. In addition, a RI (refraction index) detector was used as the detector.

The glass transition temperature (Tg) of the resin constituting the toner particles was measured as follows. Specifically, a thermogravimetry—differential scanning calorimetric (TG-DSC) system TAS-100 from RIGAKU CORPORATION was used as the instrument. Initially, 10 mg of a sample was set in an aluminum sample container, and the container was set on the holder unit, followed by setting the holder unit to the electric furnace of the instrument. The sample was heated from room temperature to 150° C. at a temperature rising speed of 10° C./min, and the sample was allowed to settle for 10 minutes at 150° C. Next, the sample was cooled to room temperature and the sample was allowed to settle for 10 minutes at room temperature. The sample was heated again from room temperature to 150° C. at a temperature rising speed of 10° C./min to obtain the DSC curve. The glass transition temperature (Tg) of the resin was determined by using an analysis system of the instrument. Specifically, the glass transition temperature (Tg) was determined based on the tangent line of the endothermic curve near the glass transition temperature and the base line of the DSC curve.

The acid value of the resin constituting the toner particles was measured by a method described in JIS K1557-1970. Specifically, about 2 g of a sample, which had been pulverized, was precisely weighed, and the sample was fed to a 200-ml conical flask. After 100 ml of a mixture solvent including 2 parts by weight of toluene and 1 part by weight of ethanol was added to the conical flask, the mixture was agitated for 5 hours to dissolve the sample, and a phenolphthalein solution was added thereto as an indicator. Next, a 0.1N alcohol solution of potassium hydroxide was dropped using a burette until the color of the indicator was changed while checking the amount (S ml) of the dropped alcohol solution of potassium hydroxide. In addition, a blank test was performed to determine the amount (B ml) of the dropped alcohol solution of potassium hydroxide. The acid value of the resin was determined from the following equation:

$$\text{Acid value}=[(S-B)\times f\times 5.61]/W,$$

wherein f represents the factor of the alcohol solution of potassium hydroxide, and W represents the weight (gram) of the sample.

The particle diameter and particle diameter distribution of raw materials used for preparing the toners were measured as follows.

Specifically, the particle diameter and particle diameter distribution of a sample was measured by an instrument UPA-150EX from Nikkiso Co., Ltd. Initially, 3 ml of pure water was fed into a cell of the instrument, and a dispersion of the sample, which was properly diluted, was gradually added thereto until the loading index of the instrument fell in a range of from 0.5 to 3.0, followed by measurement of the volume of particles and the number of the particles of the sample. Thus, the volume particle diameter distribution (and the volume average particle diameter) and the number-size particle diameter distribution (and the number average particle diameter) were determined. In this regard, the measurement range was from 0.8 to 6,500 nm, and the measuring time was 6 seconds.

Next, several examples of toner, which were prepared by using the toner producing apparatus of this disclosure illustrated in FIG. 3, and comparative examples of toner, which were prepared by using the conventional toner producing apparatus, which include the solvent removing device 350 or 450, were prepared and evaluated.

Example 1

Initially, a dispersion liquid for use in preparing the toner was prepared using the dispersion liquid producing device 1.

Specifically, the following components were fed into a reaction vessel equipped with an agitator and a thermometer.

| | |
|---|---|
| Water | 683 parts |
| Sodium salt of sulfate of ethylene oxide adduct of methacrylic acid (ELEMINOL RS-30 from Sanyo Chemical Industries Ltd.) | 11 parts |
| Styrene | 83 parts |
| Methacrylic acid | 83 parts |
| Butyl acrylate | 110 parts |
| Ammonium persulfate | 1 part |

The mixture in the reaction vessel was agitated by the agitator for 15 minutes at a revolution of 400 rpm, resulting in preparation of a white emulsion.

The white emulsion was heated so that the temperature of the system becomes 75° C., followed by a reaction of the emulsion for 5 hours at 75° C. Next, 30 parts of a 1% by weight aqueous solution of ammonium persulfate was added thereto, and the mixture was aged for 5 hours at 75° C. to prepare an aqueous dispersion liquid of a vinyl resin (i.e., a copolymer of styrene-methacrylic acid-butyl acrylate-sodium salt of sulfate of ethylene oxide adduct of methacrylic acid, hereinafter referred to as an organic particulate resin dispersion liquid 1). It was confirmed that the volume average particle diameter of the organic particulate resin dispersion liquid 1, which is measured by an instrument LA-920 from HORIBA LTD., is 105 nm. In addition, part of the organic particulate resin dispersion liquid 1 was dried to obtain a solid resin, and the glass transition temperature (Tg) and the weight average molecular weight of the resin were measured. As a result, it was confirmed that the glass transition temperature (Tg) is 59° C., and the weight average molecular weight is 150,000.

The dispersion liquid producing device 1 includes the above-mentioned reaction vessel, and a second reaction vessel, which is equipped with a cooling device, an agitator, and a nitrogen feed pipe. The following components were fed into the second reaction vessel.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Isophthalic acid | 46 parts |
| Dibutyltin oxide | 2 parts |

After the mixture was reacted for 5 hours in the second reaction vessel under conditions of normal pressure and 230° C. in temperature, 44 parts of trimellitic anhydride was fed into the second reaction vessel, and the mixture was reacted for 2 hours under conditions of normal pressure and 180° C. in temperature. Thus, a polyester 1 was prepared. It was confirmed that the tetrahydrofuran (THF)-soluble components of the polyester resin 1 has a weight average molecular weight of 5,200, a glass transition temperature (Tg) of 45° C., and an acid value of 20 mgKOH/g.

The dispersion liquid producing device 1 further includes a third reaction vessel, which is equipped with a cooling device, an agitator, and a nitrogen feed pipe. The following components were fed into the third reaction vessel.

| | |
|---|---|
| Ethylene oxide (2 mole) adduct of bisphenol A | 795 parts |
| Isophthalic acid | 200 parts |
| Terephthalic acid | 65 parts |
| Dibutyltin oxide | 2 parts |

The mixture was reacted for 8 hours at 210° C. in the third reaction vessel while flowing a normal-pressure nitrogen gas thereinto. Next, the reaction product was further reacted for 5 hours at a reduced pressure of from 1.3 to 2.0 kPa while removing generated water, followed by cooling to 80° C. Further, 170 parts of isophorone diisocyanate was added thereto, and the mixture was reacted for 2 hours to prepare a prepolymer 1. It was confirmed that the prepolymer 1 has a weight average molecular weight of 5,000.

The dispersion liquid producing device 1 further includes a HENSCHEL MIXER mixer (from Mitsui Mining Co., Ltd.). The following components were mixed by the HENSCHEL MIXER mixer.

| | |
|---|---|
| Water | 1200 parts |
| Modified bentonite subjected to ion exchange using quaternary ammonium ion (BENTONE 57 from Elementis Specialties) | 174 parts |
| Polyester 1 | 1570 parts |

After the mixture was kneaded for 30 minutes at 150° C. using a two-roll kneader, the mixture was subjected to roll cooling, followed by pulverization using a pulverizer (from HOSOKAWA MICRON CORPORATION) to prepare a master batch 1. In this regard, the volume average particle diameter of the modified bentonite was 0.4 μm, and the content of particles having a particle diameter of not less than 1 μm was 2% by volume.

The dispersion liquid producing device 1 further includes an agitating tank. The following components were fed into the agitating tank.

| | |
|---|---|
| Prepolymer 1 | 23.4 parts |
| Polyester 1 | 123.6 parts |
| Master batch 1 | 20 parts |

The mixture was agitated in the agitating tank.

In addition, the following components were mixed in a container.

| | |
|---|---|
| Carnauba wax | 15 parts |
| Carbon black | 20 parts |
| Ethyl acetate | 120 parts |

The mixture was subjected to a dispersing treatment for 1 hour using a bead mill.

The thus prepared dispersion liquid was fed into the agitating tank, and the mixture was agitated for 3 hours, followed by a circulation dispersing treatment for 6 hours using a high-efficiency disperser (EBARA MILDER from EBARA CORPORATION). Further, 2.9 parts of isophoronediamine was added thereto, and the mixture was subjected to a circulation dispersing treatment for 1 hour to prepare an oil phase liquid.

Next, the following components were mixed in a container while agitated to prepare an aqueous solvent.

| | |
|---|---|
| Ion exchange water | 529.5 parts |
| Organic particulate resin dispersion liquid 1 | 1.70 parts |
| Sodium dodecylbenzenesulfonate | 0.5 parts |

The aqueous solvent and the oil phase liquid prepared above were supplied to a mixer (PIPELINE HOMOMIXER from PRIMIX Corp.) of the dispersion liquid producing device 1 at flow speeds of 438 kg/hour and 282 kg/hour, respectively. The mixture was continuously mixed by the mixer for 960 minutes at a revolution of 2,960 rpm. Thus, 11,520 kg of a dispersion liquid having a temperature of 23° C. was prepared. The content of the organic solvent in the dispersion liquid was 20.5% by weight.

In parallel with the production of the dispersion liquid, transfer of the dispersion from the dispersion liquid producing device 1 to the storage 20, transfer of the dispersion liquid from the storage 20 to the solvent removing device 50, and solvent removal using the solvent removing device 50 were performed. The pressure of the dispersion liquid in the mixer (PIPELINE HOMOMIXER) was maintained at 10 kPa, and the pressure of the dispersion liquid in the storage tank 21 was maintained so as to fall in a range of from 0 to 5 kPa. In addition, the pressure of the dispersion liquid and the organic solvent in the agitating tank 51 was maintained at −95.5 kPa. The suction speed (i.e., dispersion liquid sucking rate) of the suction pump 56 was controlled so as to be not greater than 10 times the dispersion liquid flow rate (i.e., the flow rate (kg/hr) of the dispersion liquid fed from the dispersion liquid producing device 1 to the storage tank 21) so that the concentration of the solvent in the dispersion liquid in the agitating tank 51 is decreased to a certain concentration. In this regard, a defoaming agent (emulsion-type polyether-modified silicone compound including octamethylcyclotetrasiloxane (D4) in an amount of 5% by weight) was supplied to the agitating tank 51 by the defoaming agent supply pump 28 to prevent foaming of the dispersion liquid. In FIG. 3, the defoaming agent supply pump is connected with the storage tank 21. However, in Example 1 the defoaming agent supply pump 28 was connected with the agitating tank 51 with a temporary pipe to supply the defoaming agent to the agitating tank 51. Thus, it is possible to supply a defoaming agent to the agitating tank 51. The feeding speed of the defoaming agent was controlled so that the concentration of the defoaming agent becomes about 1080 ppm based on the weight of the resin particles in the dispersion liquid in the agitating tank 51.

The production speed of the dispersion liquid in the dispersion liquid producing device 1 and the solvent removing speed of the solvent removing device 50 were adjusted so that it takes a time of from 0 to 60 minutes for the dispersion liquid to be fed from the dispersion liquid producing device 1 to the solvent removing device 50 via the storage 20, and the solvent concentration of the concentrated dispersion liquid becomes not higher than 500 ppm.

Since almost all the organic solvent was removed from the concentrated dispersion liquid, the liquid component of the concentrated dispersion liquid was substantially the aqueous solvent. Therefore, even when the concentrated dispersion liquid was allowed to settle, the particle diameter of resin particles in the concentrated dispersion liquid was hardly changed. In Example 1, after the concentrated dispersion liquid was retained for about 10 hours at 45° C. in the condensation and collection tank 57, the concentrated dispersion liquid was fed to the drying device to be subjected to filtering, washing and drying treatments. The glass transition temperature (Tg) of the resin component of the dried toner was 50° C.

Example 2

The procedure for preparation of the toner in Example 1 was repeated except that the pressure in the agitating tank 51 of the solvent removing device 50 was changed to −94.5 kPa by adjusting the driving amount of the suction pump 56. Thus, a toner of Example 2 was prepared.

Example 3

The procedure for preparation of the toner in Example 1 was repeated except that pure water in an amount of 10% by weight of the dispersion liquid was supplied to the storage tank 21 by the pure water supply pump 26. Thus, a toner of Example 3 was prepared.

Example 4

The procedure for preparation of the toner in Example 1 was repeated except that the temperature (t) of the dispersion liquid in the storage tank 21 was controlled at 27° C. by turning on or off the heater 22. Thus, a toner of Example 4 was prepared.

Example 5

The procedure for preparation of the toner in Example 1 was repeated except that the temperature (t) of the dispersion liquid in the agitating tank 51 was controlled at 19° C. by turning on or off the heater. Thus, a toner of Example 5 was prepared.

Example 6

The procedure for preparation of the toner in Example 1 was repeated except that the temperature (t) of the dispersion liquid in the storage tank 21 was controlled at 27° C. by turning on or off the heater 22, and the temperature (t) of the dispersion liquid in the agitating tank 51 was controlled at 19° C. by turning on or off the heater. Thus, a toner of Example 6 was prepared.

Example 7

The procedure for preparation of the toner in Example 1 was repeated except that the temperature (t) of the dispersion liquid in the storage tank 21 was controlled at 40° C. by turning on or off the heater 22. Thus, a toner of Example 7 was prepared.

Example 8

The procedure for preparation of the toner in Example 1 was repeated except that the pressure in the agitating tank 51 of the solvent removing device 50 was changed to −85.0 kPa by adjusting the driving amount of the suction pump 56, and the temperature (t) of the dispersion liquid in the agitating tank 51 was controlled at 40° C. by turning on or off the heater 52. Thus, a toner of Example 8 was prepared.

Example 9

The procedure for preparation of the toner in Example 1 was repeated except that the defoaming agent was supplied by the defoaming agent supply pump 28 to the storage tank 21 instead of the agitating tank 51. Thus, a toner of Example 9 was prepared.

Example 10

The procedure for preparation of the toner in Example 1 was repeated except that the defoaming agent was not used. In this case, in order to reduce foaming of the dispersion liquid in the storage tank 21 to an acceptable level, it was necessary to control the suction speed (i.e., dispersion liquid sucking rate) of the suction pump 56 so as to be not greater than twice the dispersion liquid flow rate. Therefore, the toner was produced under the condition. In addition, when the solvent removal process was performed as a batch operation, it was necessary to gradually perform the solvent removal process over a time about twice the time taken for performing the solvent removal process on the dispersion liquid including the defoaming agent. Thus, a toner of Example 10 was prepared.

Comparative Example 1

The procedure for preparation of the toner in Example 1 was repeated except that a conventional continuous toner producing apparatus including the solvent removing device 450 illustrated in FIG. 2 was used instead of the toner producing apparatus illustrated in FIG. 3. Specifically, the defoaming agent was supplied as illustrated by the arrow E in FIG. 2 to the dispersion liquid fed by the squeeze pump 410. The composition, concentration and added amount of the defoaming agent were the same as those in Example 1. In addition, other conditions were the same as those in Example 1. Thus, a toner of Comparative Example 1 was prepared.

Comparative Example 2

The procedure for preparation of the toner in Example 1 was repeated except that a conventional batch toner producing apparatus including the solvent removing device 350 illustrated in FIG. 1 was used instead of the toner producing apparatus illustrated in FIG. 3. In the storage tank located on an upstream side from the solvent removing device 350, the pressure of the dispersion liquid was controlled at normal pressure, and the dispersion liquid was transferred from the storage tank to the agitating tank 351 only by using the negative pressure in the agitating tank 351. The defoaming agent was supplied to the agitating tank 351 as illustrated by the arrow E in FIG. 1. The composition and concentration of the defoaming agent were the same as those in Example 1, but the added amount of the defoaming agent was changed to an amount (about 1620 ppm), which is 1.5 times that in Example 1, because the amount of foam in the tank was greater than that in Example 1. Other conditions were the same as those in Example 1. Thus, a toner of Comparative Example 2 was prepared.

Comparative Example 3

The procedure for preparation of the toner in Example 1 was repeated except that a conventional batch toner producing apparatus including the solvent removing device 350 illustrated in FIG. 1 was used instead of the toner producing apparatus illustrated in FIG. 3. In the storage tank located on an upstream side from the solvent removing device 350, the pressure of the dispersion liquid was controlled at normal pressure, and the dispersion liquid was transferred from the storage tank to the agitating tank 351 only by using the negative pressure in the agitating tank 351. Pure water was supplied to the dispersion liquid, which was fed through the pipe, as illustrated by the arrow D in FIG. 1. The added amount of pure water was 30% by weight of the dispersion liquid. In addition, the defoaming agent was supplied to the agitating tank 351 as illustrated by the arrow E in FIG. 1. The composition and concentration of the defoaming agent were the same as those in Example 1. The added amount of the defoaming agent was changed to an amount (about 1620 ppm), which is 1.5 times that in Example 1, because the amount of foam in the tank was greater than that in Example 1. Other conditions were the same as those in Example 1. Thus, a toner of Comparative Example 3 was prepared.

The dispersion liquids and toners of Examples 1-10 and Comparative Examples 1-3 were evaluated as follows.

1. Concentration of Organic Solvent in Dispersion Liquid

In each of Examples 1-10 and Comparative Examples 1-3, the dispersion liquid to be fed to the agitating tank (51, 351 or 451) of the solvent removing device (50, 350 or 450) was sampled from a branched pipe located just before the agitating tank, and the concentration of the organic solvent in the dispersion liquid was measured just after the sampling. In addition, the concentration (i.e., final solvent concentration) of the organic solvent in the concentrated dispersion liquid stored in the condensation and collection tank (57, 357 and 457) at a time 30 minutes after storage of the concentrated dispersion liquid in the condensation and collection tank was measured.

Since the organic solvent included in the dispersion liquid was ethyl acetate, the concentration of ethyl acetate was measured to determine the concentration of the organic solvent. Specifically, a gas chromatography equipment GC-2010 from Shimadzu Corporation was used as the instrument. In a 50 ml screw vial, 1.5 g of the dispersion liquid, 10 ml of an internal standard liquid, which had been prepared by adding 1.00 g of toluene to a 500 ml measuring flask and then adding dimethylformamide (DMF) so that the total volume of the mixture solvent becomes 500 ml, and DMF were mixed and agitated so that the volume of the mixture became 50 ml to prepare a sample for analysis. The sample was fed into a 1.5 ml screw vial using a clean pipette, and the screw vial was set to the gas chromatography equipment to measure the concentration of ethyl acetate in the dispersion liquid. The measuring conditions were as follows.

Mode of injecting the sample into the vaporing chamber: Sprit

Temperature in the vaporing chamber: 180° C.

Carrier gas used: He

Pressure: 40.2 kPa

Total flow: 56.0 ml/min

Column flow: 1.04 ml/min

Linear speed: 20.0 cm/sec

Purge flow: 3.0 ml/min

Sprit ratio: 50.0

Name of the column: ZB-50

Film thickness of liquid phase: 0.25 μm
Length of the column: 30.0 m
Inside diameter of the column: 0.32 mm
ID column upper limit: 340° C.
Open column temperature: 60° C.
Temperature changing program: 60° C. (held for 6 minutes)→heating at a temperature rising speed of 60° C./min→230° C. (held for 5 minutes)
Temperature detected by the detector: 250° C.
Makeup gas used: $N_2$/Air
Makeup gas flow: 30.0 ml/min
$N_2$ flow: 47.0 ml/min
Air flow: 400 ml/min 2. Particle Diameter Distribution of Toner The particle diameter distribution of each of the toners was measured. Specifically, the volume average particle diameter of the toner was measured by a COULTER COUNTER method using COULTER COUNTER TA-II (from Beckman Coulter Inc.). In this regard, COULTER MULTISIZER II and COULTER MULTISIZER III can also be used as the instrument. In the measurement, initially, a surfactant serving as a dispersant (preferably 0.1 to 5 ml of a 1% aqueous solution of an alkylbenzenesulfonic acid salt) was added to 100 to 150 ml of an electrolyte. The electrolyte was a 1% aqueous solution of first class NaCl (alternatively, ISOTON-II (from Beckman Coulter Inc.) can be used as the electrolyte). Next, 2 to 20 milligrams of a sample (toner) to be measured is added into the mixture. The mixture is subjected to an ultrasonic dispersing treatment for about 1 to 3 minutes to prepare a toner suspension (i.e., sample liquid). The sample liquid was set to the instrument equipped with a 100 μm aperture to measure the particle diameters of randomly chosen plural toner particles. Based on the particle diameters, and the volumes and numbers of the measured toner particles, the volume particle diameter distribution and number-size particle diameter distribution were determined. By using this method, the volume average particle diameter (Dv), the number average particle diameter (Dn), the Dv/Dn ratio (distribution), the fine particle ratio FPR (i.e., ratio of fine toner particles having a particle diameter of not greater than 3.17 μm in the toner), and the coarse particle ratio CPR (i.e., ratio of coarse toner particles having a particle diameter of not less than 10.08 μm in the toner) of the toner were determined. In this particle diameter measurement, particles having a particle diameter in a range of from 2.00 μm to 40.30 μm were the object to be measured.

In this particle diameter measurement, the following 13 channels were used.

(1) Not less than 2.00 μm and less than 2.52 μm;
(2) Not less than 2.52 μm and less than 3.17 μm;
(3) Not less than 3.17 μm and less than 4.00 μm;
(4) Not less than 4.00 μm and less than 5.04 μm;
(5) Not less than 5.04 μm and less than 6.35 μm;
(6) Not less than 6.35 μm and less than 8.00 μm;
(7) Not less than 8.00 μm and less than 10.08 μm;
(8) Not less than 10.08 μm and less than 12.70 μm;
(9) Not less than 12.70 μm and less than 16.00 μm;
(10) Not less than 16.00 μm and less than 20.20 μm;
(11) Not less than 20.20 μm and less than 25.40 μm;
(12) Not less than 25.40 μm and less than 32.00 μm; and
(13) Not less than 32.00 μm and less than 40.30 μm.

3. Change (1) of Particle Diameter Distribution of Dispersion Liquid

The particle diameter distribution of the dispersion liquid, which was just discharged from the dispersion liquid producing device, and the particle diameter distribution of the dispersion liquid, which was sampled just before the agitating tank (51, 351 or 451) were measured, to obtain the difference (in absolute value) in Dv (hereinafter referred to as |ΔDv1|), the difference (in absolute value) in Dn (hereinafter referred to as |ΔDn1|), the difference in ratio (Dv/Dn) (hereinafter referred to as |Δ(Dv/Dn)1|), the difference in fine particle ratio (FPR) (hereinafter referred to as |ΔFPR1|), and the difference in coarse particle ratio (CPR) (hereinafter referred to as |ΔCPR1|). This measurement was made to determine the degree of miniaturization or coarsening of the particles in the dispersion liquid feeding process.

These particle diameter distribution properties of the dispersion liquid were classified into the following four grades.

(1) |ΔDv1|
◎: |ΔDv1| is not greater than 0.05 μm. (Excellent)
○: |ΔDv1| is greater than 0.05 μm, and not greater than 0.10 μm.
Δ: |ΔDv1| is greater than 0.10 μm, and not greater than 0.20 μm.
×: |ΔDv1| is greater than 0.20 μm. (Bad)
(2) |Δ(Dv/Dn)1|
◎: |Δ(Dv/Dn)1| is not greater than 0.005. (Excellent)
○: |Δ(Dv/Dn)1| is greater than 0.005, and not greater than 0.01.
Δ: |Δ(Dv/Dn)1| is greater than 0.01, and not greater than 0.02.
×: |Δ(Dv/Dn)1| is greater than 0.02. (Bad)
(3) |ΔFPR1|
◎: |ΔFPR1| is not greater than 1.0%. (Excellent)
○: |ΔFPR1| is greater than 1.0%, and not greater than 2.0%.
Δ: |ΔFPR1| is greater than 2.0%, and not greater than 3.0%.
×: |ΔFPR1| is greater than 3.0%. (Bad)

4. Change (2) of Particle Diameter Distribution of Dispersion Liquid

Similarly to the above-mentioned method for determining the change (1) of the particle diameter distribution of dispersion liquid, the particle diameter distribution of the concentrated dispersion liquid in the condensation and collection tank (57, 357 or 457), and the particle diameter distribution of the dispersion liquid, which was fed to the agitating tank (51, 351 or 451) were determined to determine change of particle diameter distribution when the dispersion liquid is transferred from the agitating tank to the condensation and collection tank by subtracting the data of the particle diameter distribution of the dispersion liquid, which was fed to the agitating tank, from the data of the particle diameter distribution of the concentrated dispersion liquid in the condensation and collection tank. Namely, ΔDv2, ΔDn2, Δ(Dv/Dn)2, ΔFPR2 and ΔCPR2 were determined This measurement was made to determine whether the effect of preventing agglomeration of the particles can be produced in the continuous solvent removal process.

These particle diameter distribution properties of the dispersion liquid were classified into the following four grades.

(1) ΔDv2
◎: ΔDv2 is not greater than 0.05 μm. (Excellent)
○: ΔDv2 is greater than 0.05 μm, and not greater than 0.10 μm.
Δ: Δ6Dv2 is greater than 0.10 μm, and not greater than 0.20 μm.
×: ΔDv1 is greater than 0.20 μm. (Bad)
(2) Δ(Dv/Dn)2
◎: Δ(Dv/Dn)2 is not greater than 0.005. (Excellent)
○: Δ(Dv/Dn)2 is greater than 0.005, and not greater than 0.01.
Δ: Δ(Dv/Dn)2 is greater than 0.01, and not greater than 0.02.

×: Δ(Dv/Dn)2 is greater than 0.02. (Bad)

(3) ΔCPR2

◎: ΔCPR2 is not greater than 1.0%. (Excellent)

○: ΔCPR2 is greater than 1.0%, and not greater than 2.0%.

Δ: ΔCPR2 is greater than 2.0%, and not greater than 3.0%.

×: ΔCPR2 is greater than 3.0%. (Bad)

5. Ratio of Coarse Particles in Toner

Each toner having a weight of 0.5 g was set on a screen having openings of 25 μm, and the toner was sucked from the opposite side of the screen to determine the weight of the toner remaining on the screen (i.e., coarse particles having a particle diameter of not less than 25 μm) to determine the coarse particle weight ratio (%) of the toner.

The coarse particle weight ratio was classified into the following four grades.

◎: The coarse particle weight ratio is not greater than 0.5%. (Excellent)

○: The coarse particle weight ratio is greater than 0.5% and not greater than 1.0%.

Δ: The coarse particle weight ratio is greater than 1.0% and not greater than 2.0%.

×: The coarse particle weight ratio is greater than 2.0%. (Bad)

6. Overall Evaluation

The toners were subjected to overall evaluation based on the evaluation results mentioned above. Specifically, the following points were given to the four grades in each evaluation. ◎: +1 point ○: 0 point Δ: −1 point ×: −2 point The points of the above-mentioned evaluations 1-6 were totalized for each toner, and the toners were graded as follows.

◎: The total points of the toner are not less than +5 points.

○: The total points of the toner are from 0 to +4 points.

Δ: The total points of the toner are from −2 to −1 point.

×: The total points of the toner are less than −2 point.

The production conditions of the dispersion liquids and toners of Examples 1-10 and Comparative Examples 1-3 are shown in Tables 1-1 and 1-2 below, and the evaluation results thereof are shown in Tables 2-1 and 2-2 below.

TABLE 1-1

| | Production of dispersion liquid | | Pure water dilution ratio | Storage tank | |
|---|---|---|---|---|---|
| | Method | Apparatus | (% by weight) | Heated or non-heated | Temperature of dispersion liquid in dispersion liquid producing device (° C.) |
| Ex. 1 | Continuous method of this disclosure | Apparatus illustrated in FIG. 3 | — | Non-heated | 23 |
| Ex. 2 | Continuous method of this disclosure | Apparatus illustrated in FIG. 3 | — | Non-heated | 23 |
| Ex. 3 | Continuous method of this disclosure | Apparatus illustrated in FIG. 3 | 10 | Non-heated | 23 |
| Ex. 4 | Continuous method of this disclosure | Apparatus illustrated in FIG. 3 | — | Heated | 27 |
| Ex. 5 | Continuous method of this disclosure | Apparatus illustrated in FIG. 3 | — | Non-heated | 23 |
| Ex. 6 | Continuous method of this disclosure | Apparatus illustrated in FIG. 3 | 10 | Heated | 27 |
| Ex. 7 | Continuous method of this disclosure | Apparatus illustrated in FIG. 3 | — | Heated | 40 |
| Ex. 8 | Continuous method of this disclosure | Apparatus illustrated in FIG. 3 | — | Non-heated | 23 |
| Ex. 9 | Continuous method of this disclosure | Apparatus illustrated in FIG. 3 | — | Non-heated | 23 |
| Ex. 10 | Continuous method of this disclosure | Apparatus illustrated in FIG. 3 | — | Non-heated | 23 |
| Comp. Ex. 1 | Conventional continuous method | Apparatus illustrated in FIG. 2 | 10 | Storage tank was not used. | |
| Comp. Ex. 2 | Conventional batch method | Apparatus illustrated in FIG. 1 | — | Storage tank was not used. | |
| Comp. Ex. 3 | Conventional batch method | Apparatus illustrated in FIG. 1 | 30 | Storage tank was not used. | |

TABLE 1-2

| | Solvent removing device | | | | Defoaming agent | |
|---|---|---|---|---|---|---|
| | Pressure in tank (kPa) | Flow rate (relative to dispersion liquid flow rate) | Heated or non-heated | Final temperature of dispersion liquid (° C.) | Site of addition of deforming agent | Added amount (ppm) |
| Ex. 1 | 5.8 | Not greater than 10 times | Non-heated | 12.7 | Agitating tank | 1080 |
| Ex. 2 | 7.3 | Not greater than 10 times | Non-heated | 15.8 | Agitating tank | 1080 |
| Ex. 3 | 5.8 | Not greater than 10 times | Non-heated | 12.6 | Agitating tank | 1080 |
| Ex. 4 | 5.8 | Not greater than 10 times | Non-heated | 12.6 | Agitating tank | 1080 |
| Ex. 5 | 5.8 | Not greater than 10 times | Heated | 19.0 | Agitating tank | 1080 |
| Ex. 6 | 5.8 | Not greater than 10 times | Heated | 19.5 | Agitating tank | 1080 |
| Ex. 7 | 5.8 | Not greater than 10 times | Non-heated | 12.7 | Agitating tank | 1080 |
| Ex. 8 | 16.2 | Not greater than 10 times | Heated | 40.2 | Agitating tank | 1080 |
| Ex. 9 | 5.8 | Not greater than 10 times | Non-heated | 12.6 | Storage tank | 1080 |
| Ex. 10 | 5.8 | Not greater than twice | Non-heated | 12.5 | Not added | 0 |
| Comp. Ex. 1 | 5.8 | Equal to dispersion liquid flow rate | Non-heated | 12.6 | Point E illustrated in FIG. 2 | 1080 |
| Comp. Ex. 2 | | — | | | Point E illustrated in FIG. 1 | 1620 |
| Comp. Ex. 3 | | — | | | Point E illustrated in FIG. 1 | 1620 |

TABLE 2-1

| | Dispersion liquid feeding process | | | | |
|---|---|---|---|---|---|
| | Concentration of solvent just after reception (%) | Final concentration of solvent (%) | Change (1) of particle diameter distribution | | |
| | | | \|ΔDv1\| | \|Δ(Dv/Dn)1\| | \|ΔFPR1\| |
| Ex. 1 | 13.0 | 12.5 | ○ | ◎ | ◎ |
| Ex. 2 | 15.4 | 15.0 | ○ | ◎ | ◎ |
| Ex. 3 | 11.2 | 10.6 | ◎ | ◎ | ◎ |
| Ex. 4 | 10.4 | 9.9 | ○ | ◎ | ◎ |
| Ex. 5 | 12.9 | 4.8 | ○ | ◎ | ◎ |
| Ex. 6 | 7.8 | 4.5 | ◎ | ◎ | ◎ |
| Ex. 7 | 3.3 | 2.6 | Δ | Δ | Δ |
| Ex. 8 | 20.3 | 4.8 | ○ | ◎ | ◎ |
| Ex. 9 | 12.9 | 12.4 | ○ | ◎ | ◎ |
| Ex. 10 | 12.5 | 12.2 | ○ | ◎ | ○ |
| Comp. Ex. 1 | 11.3 | 10.7 | Δ | Δ | X |
| Comp. Ex. 2 | 20.5 | 20.4 | ◎ | ◎ | ◎ |
| Comp. Ex. 3 | 15.8 | 15.7 | ◎ | ◎ | ◎ |

TABLE 2-2

| | After receiving dispersion liquid Change (2) of particle diameter distribution | | | Toner Coarse particle | Overall evaluation |
|---|---|---|---|---|---|
| | ΔDv2 | Δ(Dv/Dn)2 | ΔCPR2 | weight ratio | (total points) |
| Ex. 1 | ○ | ○ | ○ | ◎ | ○(+3) |
| Ex. 2 | Δ | ○ | Δ | ○ | ○(0) |
| Ex. 3 | ○ | ◎ | ◎ | ◎ | ◎(+6) |

TABLE 2-2-continued

| | After receiving dispersion liquid Change (2) of particle diameter distribution | | | Toner Coarse particle | Overall evaluation |
|---|---|---|---|---|---|
| | ΔDv2 | Δ(Dv/Dn)2 | ΔCPR2 | weight ratio | (total points) |
| Ex. 4 | ◎ | ◎ | ◎ | ◎ | ◎(+6) |
| Ex. 5 | ◎ | ◎ | ◎ | ○ | ◎(+6) |
| Ex. 6 | ◎ | ◎ | ◎ | ○ | ◎(+7) |
| Ex. 7 | ◎ | ◎ | ◎ | Δ | ○(0) |
| Ex. 8 | ○ | ○ | ○ | Δ | ○(+2) |
| Ex. 9 | ○ | ○ | ○ | ◎ | ○(+2) |
| Ex. 10 | ○ | ○ | ○ | ◎ | ○(+3) |
| Comp. Ex. 1 | ○ | ◎ | ◎ | ◎ | Δ(−2) |
| Comp. Ex. 2 | X | X | X | X | X(−7) |
| Comp. Ex. 3 | Δ | Δ | Δ | Δ | X(−3) |

The following can be easily understood from Tables 1-1, 1-2, 2-1 and 2-2.

The toner producing apparatus of this disclosure used for Examples 1-10 can prevent occurrence of the problem in that the particle diameter distribution of particles in the dispersion liquid broadens in the dispersion liquid feeding process and the solvent removal process although the conventional continuous toner producing apparatus used for Comparative Example 1 and the conventional batch toner producing apparatus used for Comparative Examples 2 and 3 cannot prevent occurrence of the problem. In particular, in Examples 3 and 6, in which pure water is added in an amount of 10% by weight based on the weight of the dispersion liquid before the dispersion liquid is subjected to the solvent removing treatment to reduce the solvent concentration, broadening of the particle diameter distribution of particles in the dispersion liquid can be prevented more effectively.

It can be understood from Example 7 that in order to maintain the particle diameter distribution of particles in the dispersion liquid right after preparation of the dispersion liquid, it is preferable to control the temperature (t) of the dispersion liquid before the solvent removing treatment in a range of from 5° C. to a temperature (Tg−10)(° C.), wherein Tg represents the glass transition temperature of the resin constituting the particles.

It can be understood from Example 10 and Comparative Example 1 that in order to continuously remove the organic solvent from the dispersion liquid efficiently, it is effective to prevent foaming of the dispersion liquid using a defoaming agent.

It can be understood from Comparative Example 1 using the conventional continuous toner producing apparatus illustrated in FIG. 2 that the evaluation results of |ΔDv1|, |ΔDn1|, |Δ(Dv/Dn)1|, |ΔFPR1| and |ΔCPR1| are bad, but the evaluation results of |ΔDv2|, |ΔDn2|, |Δ(Dv/Dn)2|, |ΔFPR2| and |ΔCPR2| are relatively good compared with the evaluation results of |ΔDv1|, |ΔDn1|, |Δ(Dv/Dn)1|, |ΔFPR1| and |ΔCPR1|. Therefore, it can be understood that the concentrated dispersion liquid, which is subjected to the solvent removing treatment, does not change the particle diameter distribution, but fine particles are formed when the dispersion liquid is fed to the solvent removing device.

In order to prevent occurrence of the problems in that the particle diameter distribution broadens and coarse particles are formed when the dispersion liquid is fed (in the continuous toner producing method) or the dispersion is stored (in the batch toner producing method), it is preferable that the final solvent concentration is as low as possible.

It can be understood form Examples 5 and 8 that by performing the solvent removing treatment in the above-mentioned temperature range of from 5° C. to a temperature (Tg−10)(° C.), broadening of the particle diameter distribution of particles can be prevented while preventing agglomeration of the particles.

In Comparative Example 3 using the conventional batch toner producing apparatus, pure water is added to the dispersion liquid in an amount, which is the upper limit of the addition amount range in which the properties and productivity of the toner are not deteriorated by pure water added, but the effect of pure water is insufficient. Therefore, it can be understood that the continuous toner producing apparatus is better that the batch toner producing apparatus.

It can be understood that the amount of the VOC (D4) derived from the defoaming agent remaining in the toner changes depending on the added amount (concentration) and the addition site of the defoaming agent, and the final concentration of the solvent.

It can be understood from comparison of Examples 1-10 and Comparative Example 1, which use continuous toner producing apparatus, with Comparative Example 2 and 3, which use batch toner producing apparatus that by continuously performing the solvent removing treatment, the added amount of defoaming agent can be reduced, and in addition the amount of the VOC (D4) remaining in the toner can be reduced. This is because when the dispersion liquid is fed to the agitating tank 51, a considerable amount of organic solvent has been removed from the dispersion liquid, thereby reducing the amount (volume) of the dispersion liquid and the amount (volume) of foam, and therefore the added amount of the defoaming agent can be reduced.

The reason why the amount of the VOC (D4) remaining in the toner changes depending on the addition site of the defoaming agent is that the concentration of the solvent in the dispersion liquid changes when the addition site is changed. In this regard, as the concentration of the solvent in the dispersion liquid decreases, the amount of the VOC (D4) remaining in the toner decreases.

When the solvent removing treatment is performed in the continuous toner producing apparatus, the final concentration of the solvent in the dispersion feeding process is relatively low compared with that right before the solvent removing treatment performed in the batch toner producing apparatus. Therefore, the time taken for the solvent removing treatment can be reduced, thereby making it possible to produce the toner in a short time.

This disclosure is not limited to the example mentioned above, and includes the following embodiments, which produce specific effects, respectively.

Embodiment A

Embodiment A is a storage (20) to store a dispersion liquid (such as a resin dispersion liquid or a toner dispersion liquid) in which particles including a resin are dispersed in a solvent. The storage is characterized by including a storage tank (21) arranged on a passage leading from a dispersion liquid producing device to produce the dispersion liquid to a solvent removing device to remove the solvent from the dispersion liquid; and a pressure adjuster (such as the pressure adjuster 24) to adjust the pressure of the dispersion liquid in the storage tank to a pressure between the pressure of the dispersion liquid in the dispersion liquid producing device and the pressure of the dispersion liquid in the solvent removing device.

In the storage having such a constitution, when a decompression valve is arranged before the storage on the passage, it becomes possible to decrease the pressure difference between the pressure of the dispersion liquid before the decompression valve and the pressure of the dispersion liquid after the decompression valve so as to be relative low compared with that in conventional toner producing apparatuses. Therefore, broadening of the particle diameter distribution of the toner caused by the pressure difference can be prevented.

Embodiment B

Embodiment B is characterized in that, in the storage of Embodiment A, only when the pressure of the dispersion liquid in the storage tank is not less than the predetermined upper limit, the pressure adjuster functions to allow the fluid in the storage tank to flow from the storage tank to the outside, and only when the pressure of the dispersion liquid in the storage tank is not greater than the predetermined lower limit, the pressure adjuster functions to allow a fluid to flow into the storage tank from the outside.

Embodiment C

Embodiment C is characterized in that, in the storage of Embodiment B, the fluid, which is flowed from the outside into the storage tank when the pressure of the dispersion liquid in the storage tank is not greater than the predetermined lower limit, is an inert gas.

Embodiment D

Embodiment D is a toner producing apparatus, which includes a dispersion liquid producing device to produce a dispersion liquid, in which particles including a resin are dispersed in a solvent, and a solvent removing device to remove the solvent from the dispersion liquid, wherein the toner producing apparatus is characterized by further including the storage of Embodiment A, B or C.

Embodiment E

Embodiment E is characterized in that the toner producing apparatus of Embodiment D further includes a pressing device to press the dispersion liquid in the dispersion liquid producing device to a pressure higher than the atmospheric pressure, and a suction pump (56) to suck the gas of the solvent evaporated from the mixture fluid including the dispersion liquid and the solvent evaporated from the dispersion liquid to reduce the pressure of the mixture fluid to a pressure lower than the atmospheric pressure.

Embodiment F

Embodiment F is characterized in that the toner producing apparatus of Embodiment E further includes a valve (such as the stop valve 29) arranged at a location of the passage between the storage tank and the solvent removing device to stop flow of the dispersion liquid, a storage amount detector (such as the liquid level sensor 31) to detect the storage amount of the dispersion liquid in the storage tank, and a controller which closes the valve when the storage amount detector detects that the storage amount is not greater than a predetermined lower limit, and opens the valve when the storage amount detector detects that the storage amount is greater than the lower limit.

Embodiment G

Embodiment G is characterized in that the toner producing apparatus of Embodiment F further includes a squeeze pump (10) to pressure-transport the dispersion liquid in the dispersion liquid producing device to the storage tank, and a decompression valve (such as the back pressure valve 11) arranged at a location of the passage between the squeeze pump and the storage tank to decompress the dispersion liquid.

Embodiment H

Embodiment H is characterized in that the toner producing apparatus of Embodiment E further includes a squeeze pump (10) to pressure-transport the dispersion liquid in the dispersion liquid producing device to the storage tank, a decompression valve (such as the back pressure valve 11) arranged at a location of the passage between the squeeze pump and the storage tank, a storage amount detector (such as the liquid level sensor 31) to detect the storage amount of the dispersion liquid in the storage tank, and a controller which stops the squeeze pump when the storage amount detector detects that the storage amount is not less than the upper limit, and operates the squeeze pump when the storage amount detector detects that the storage amount is less than the upper limit.

Embodiment I

Embodiment I is characterized in that the toner producing apparatus of Embodiment F, G or H further includes a pressure detector (such as the pressure sensor 54) to detect the pressure of the mixture fluid in the solvent removing device, wherein the controller controls the driving amount of the suction pump so that the pressure detected by the pressure detector falls in a predetermined range.

Embodiment J

Embodiment J is characterized in that the toner producing apparatus of Embodiments F, G, H or I further includes a heater (such as the heaters 22 and 52) to heat the dispersion liquid in the storage tank or the dispersion liquid in the solvent removing device, and a temperature detector (such as the temperature sensor 23) to detect the temperature of the dispersion liquid in the storage tank or the temperature of the dispersion liquid in the solvent removing device, wherein the controller controls the heating amount of the heater so that the temperature of the dispersion liquid in the storage tank or the temperature of the dispersion liquid in the solvent removing device falls in a predetermined range.

As mentioned above, the storage and the toner producing apparatus of this disclosure can prevent broadening of the particle diameter distribution of toner which is caused by the pressure difference between the pressure of the dispersion liquid before a decompression valve, which is provided on a passage leading from a dispersion liquid producing device to a device performing the next process (such as the solvent removing device), and the pressure of the dispersion liquid after the decompression valve.

Additional modifications and variations of the present invention are possible in light of the above teachings. It is therefore to be understood that within the scope of the appended claims the invention may be practiced other than as specifically described herein.

What is claimed is:

1. A storage to store a dispersion liquid in which particles including a resin are dispersed in a solvent, comprising:

a storage tank to store the dispersion liquid, which is arranged on a passage leading from a dispersion liquid producing device to produce the dispersion liquid to a solvent removing device to remove the solvent from the dispersion liquid; and a pressure adjuster to adjust a pressure of the dispersion liquid in the storage tank to fall in a range of from a pressure of the dispersion liquid in the dispersion liquid producing device to a pressure of the dispersion liquid in the solvent removing device.

2. The storage according to claim 1, further comprising:

a pressure detector to detect the pressure of the dispersion liquid in the tank; and a controller to operate the pressure adjuster to flow a first fluid in the storage tank from the storage tank to outside only when the pressure detector detects that the pressure of the dispersion liquid in the storage tank is not less than a predetermined upper limit while operating the pressure adjuster to flow a second fluid from outside to the storage tank only when the pressure detector detects that the pressure of the dispersion liquid in the storage tank is not greater than a predetermined lower limit, wherein the second fluid is the same as or different from the first fluid.

3. The storage according to claim 2, wherein the second fluid is an inert gas.

4. A toner producing apparatus comprising:

a dispersion liquid producing device to produce a dispersion liquid in which particles including a resin are dispersed in a solvent;

a solvent removing device to remove the solvent from the dispersion liquid;

a passage leading from the dispersion liquid producing device to the solvent removing device to transport the dispersion liquid from the dispersion liquid producing device to the solvent removing device; and the storage according to claim 1, which is arranged on the passage.

5. The toner producing apparatus according to claim 4, further comprising:

a pressing device to press the dispersion liquid in the dispersion liquid producing device to a pressure higher than an atmospheric pressure; and a suction pump to suck a gas of the solvent from a mixture fluid including the dispersion liquid and the gas of the solvent evaporated from the dispersion liquid to reduce the pressure of the mixture fluid to a pressure lower than the atmospheric pressure.

6. The toner producing apparatus according to claim 5, further comprising:

a valve arranged at a location of the passage between the storage tank and the solvent removing device to stop flow of the dispersion liquid;

a storage amount detector to detect a storage amount of the dispersion liquid in the storage tank; and a controller which closes the valve when the storage amount detector detects that the storage amount is not greater than the lower limit, and opens the valve when the storage amount detector detects that the storage amount is greater than the lower limit.

7. The toner producing apparatus according to claim 6, further comprising:

a squeeze pump to transport the dispersion liquid in the dispersion liquid producing device to the storage tank while applying a pressure thereto, and a decompression valve arranged at a location of the passage between the squeeze pump and the storage tank to decompress the dispersion liquid.

8. The toner producing apparatus according to claim 6, further comprising:

a pressure detector to detect a pressure of the mixture fluid in the solvent removing device, wherein the controller controls a driving amount of the suction pump so that the pressure detected by the pressure detector falls in a predetermined range.

9. The toner producing apparatus according to claim 6, further comprising:

a heater to heat the dispersion liquid in the storage tank; and a temperature detector to detect a temperature of the dispersion liquid in the storage tank, wherein the controller controls a heating amount of the heater so that the temperature of the dispersion liquid in the storage tank falls in a predetermined range.

10. The toner producing apparatus according to claim 6, further comprising:

a heater to heat the dispersion liquid in the solvent removing device; and a temperature detector to detect a temperature of the dispersion liquid in the solvent removing device, wherein the controller controls a heating amount of the heater so that the temperature of the dispersion liquid in the solvent removing device falls in a predetermined range.

11. The toner producing apparatus according to claim 5, further comprising:

a squeeze pump to transport the dispersion liquid in the dispersion liquid producing device to the storage tank while applying a pressure thereto;

a decompression valve arranged at a location of the passage between the squeeze pump and the storage tank;

a storage amount detector to detect a storage amount of the dispersion liquid in the storage tank; and a controller which stops the squeeze pump when the storage amount detector detects that the storage amount is not less than the upper limit, and operates the squeeze pump when the storage amount detector detects that the storage amount is less than the upper limit.

* * * * *